US008059995B2

(12) United States Patent
Yamamoto et al.

(10) Patent No.: US 8,059,995 B2
(45) **Date of Patent: *Nov. 15, 2011**

(54) IMAGE FORMING APPARATUS INCLUDING A DEVELOPER BEARING MEMBER WITH AN ALTERNATE ELECTRIC FIELD BEING APPLIED THERETO

(75) Inventors: Takeshi Yamamoto, Yokohama (JP); Yoshinobu Baba, Yokohama (JP); Manami Haraguchi, Yokohama (JP); Kenta Kubo, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/817,523

(22) Filed: Jun. 17, 2010

(65) Prior Publication Data

US 2010/0254733 A1 Oct. 7, 2010

Related U.S. Application Data

(62) Division of application No. 11/873,759, filed on Oct. 17, 2007, now Pat. No. 7,764,910.

(30) Foreign Application Priority Data

Oct. 20, 2006 (JP) ..... 2006-287017
Oct. 12, 2007 (JP) ..... 2007-267127

(51) Int. Cl.
*G03G 15/09* (2006.01)

(52) U.S. Cl. ..... 399/270; 399/53; 399/267; 399/272; 399/279; 399/281; 399/282

(58) Field of Classification Search ..... 399/53, 399/267, 270, 272, 279, 281, 282
See application file for complete search history.

(56) References Cited

U.S. PATENT DOCUMENTS

| | | | | |
|---|---|---|---|---|
| 5,701,551 | A | 12/1997 | Honda et al. | |
| 5,712,069 | A | 1/1998 | Baba et al. | |
| 6,013,406 | A | 1/2000 | Moriki et al. | |
| 6,337,966 | B1 | 1/2002 | Yamamoto | |
| 6,564,027 | B2 | 5/2003 | Haraguchi et al. | |
| 7,020,421 | B2 | 3/2006 | Enoki et al. | |
| 7,029,813 | B2 | 4/2006 | Mikuriya et al. | |
| 7,272,348 | B2 | 9/2007 | Okamoto et al. | |
| 7,764,910 | B2 * | 7/2010 | Yamamoto et al. | 399/270 |
| 2005/0026061 | A1 | 2/2005 | Mikuriya et al. | |
| 2007/0071473 | A1 | 3/2007 | Haraguchi et al. | |

FOREIGN PATENT DOCUMENTS

| | | |
|---|---|---|
| EP | 1503250 | 2/2005 |
| JP | 60-131549 | 7/1985 |
| JP | 8-160671 | 6/1996 |
| KR | 2005-14625 | 2/2005 |

* cited by examiner

*Primary Examiner* — Ryan Walsh
(74) *Attorney, Agent, or Firm* — Fitzpatrick, Cella, Harper & Scinto

(57) ABSTRACT

An image forming apparatus including: an image bearing member; and a developer bearing member bearing a developer including a toner and a carrier, the developer bearing member developing an electrostatic image formed on the image bearing member with the developer, and the developer bearing member being applied with an alternate voltage in order to form an alternate electric field between the developer bearing member and the image bearing member, wherein assuming that electric field intensities Eb and Ed be Eb=|(Vp1−VL)/D| and Ed=|(Vp2−VL)/D|, a relationship, 0≧K1>K2, is satisfied, where K1: a gradient at Ed, and K2: a gradient at Eb, and wherein a resistivity ρb of the carrier at the electric field intensity Eb satisfies $1.1\times10^{6}\times e^{n}<\rho b<6.0\times10^{7}$ [Ω·m] (where: e is the base of natural logarithms; and $n=4\times Eb\times10^{-7}$).

5 Claims, 23 Drawing Sheets a, c, e POINTS Ea=|(Vdc−VL)/D|
b POINT Eb=|(Vp1−VL)/D|
d POINT Ed=|(Vp2−VL)/D|

D: CLOSEST DISTANCE BETWEEN PHOTOSENSITIVE MEMBER AND DEVELOPING SLEEVE

IMAGE FORMING APPARATUS INCLUDING A DEVELOPER BEARING MEMBER WITH AN ALTERNATE ELECTRIC FIELD BEING APPLIED THERETO

This is a divisional of U.S. patent application Ser. No. 11/873,759, filed Oct. 17, 2007, allowed Mar. 19, 2010.

BACKGROUND OF THE INVENTION

1. Field of the Invention

The present invention relates to an image forming apparatus such as a copying machine or a printer that visualizes an electrostatic image having been formed on an image bearing member to obtain an image. More specifically, the present invention relates to an image forming apparatus using a two-component developer including a toner and a carrier as a developer.

2. Description of the Related Art

Conventionally, in an image forming apparatus such as a copying machine or a printer employing an electrophotographic printing method, the surface of an electrophotographic photosensitive member (hereinafter simply referred to as "photosensitive member") acting as an image bearing member is uniformly charged, and thereafter this surface is exposed according to image information. Whereby, an electrostatic image (latent image) is formed on the surface of the photosensitive member. The electrostatic image having been formed on the photosensitive member is developed as a toner image using a developer by a developing device. The toner image on the photosensitive member is transferred to a recording sheet directly or via an intermediate transfer member. Thereafter, by fixing the toner image onto the recording sheet, a recorded image is obtained.

Examples of a developer include a mono-component developer substantially including only toner particles, and a two-component developer including toner particles and carrier particles. A development method of employing the two-component developer is generally advantageous in respect of capable of forming an image of higher definition and good hue or tone.

The two-component developer, in general, is the one in which magnetic particles (carrier) of which particle diameter is about 5 μm to 100 μm, and a toner of which particle diameter is about 1 μm to 10 μm are mixed at a predetermined mixing ratio. The carrier functions to bear a charged toner to carry it to a developing portion. In addition, the toner is charged to be of a predetermined charge amount of a predetermined polarity due to a frictional electrification by being mixed with the carrier.

In the meantime, recently, as an image forming apparatus such as a copying machine and a printer of an electrophotographic method continues to be digitized, to be full-colored, and to have greater processing speed, an output image thereof possesses a value as an original output article, and further much expected to enter into a printing market. Thus, it is required that an image of high quality (high definition) and of a stable image quality can be output. As one of procedures for obtaining an image of high definition, proposed is the method of causing the electrical resistance of the carrier in a two-component developer to be high (Japanese Patent Application Laid-Open No. H08-160671).

That is, normally, in the development method of using a two-component developer, the two-component developer that is borne on a developer bearing member of the developing device is carried to the developing portion opposed to an electrostatic image on the photosensitive member. Then, magnetic brush of the two-component developer on the developer bearing member is made to be in contact or to be close to the photosensitive member. Thereafter, by a predetermined developing bias having been applied to between the developer bearing member and the photosensitive member, only the toner is transferred onto the photosensitive member. Whereby, a toner image corresponding to the electrostatic image on the photosensitive member is formed. On this occasion, when the electrical resistance of the carrier that bears and carries the toner is low, there are some cases where a charge is injected into the electrostatic image through the carrier from the developer bearing member, and thus the electrostatic image is disturbed. When the charge is injected into the electrostatic image, the potential is increased due to the charging of electrostatic image, and thus an image density may become lower.

Incidentally, as a developing bias, an alternate bias voltage in which a DC voltage component and an AC voltage component are superimposed is widely used.

Recently, to enter into the above-described printing market, an electrostatic image of a high resolution has been formed. For example, in the case of 2400 dpi, a dot formation width of 1 dpi is approximately 20 μm, being extremely minute. For example, in the case where an electrostatic image is formed at such a high resolution, the electrostatic image is likely to be largely affected by the charge injection via the carrier from the developer bearing member as described above. Accordingly, it is required to end a development process without damaging such a minute electrostatic image.

Conventionally, as a photosensitive member, an OPC (organic photoconductive) photosensitive member in which a surface protecting layer, a charge transport layer, and a charge generation layer that are made of an organic material are stacked on a metal base, is widely used.

Whereas, to form an electrostatic image of a high resolution as described above, as a photosensitive member, the use of a photosensitive member of a single layer such as an amorphous silicon (non-crystalline silicon) photosensitive member (hereinafter, it is referred to as "a-Si photosensitive member") is found to be advantageous. One of the reasons can be thought as follows. That is, in the OPC photosensitive member, a charge generation mechanism in an internal part of the photosensitive member is resided in the vicinity of the base of the photosensitive member. Whereas, in the a-Si photosensitive member, the charge generation mechanism in an internal part of the photosensitive member is resided on the surface of the photosensitive member. Therefore, in the case of the a-Si photosensitive member, the charge having been generated in an internal part is not diffused before reaching the surface of the photosensitive member, and thus an electrostatic image of an extremely high brilliance can be obtained.

However, in the case of the a-Si photosensitive member, the surface resistance thereof is low as compared with that of the OPC photosensitive member, the influence of the charge injection via the carrier from the developer bearing member as described above comes to be significantly larger than the case of the OPC photosensitive member. Accordingly, in the case of using the a-Si photosensitive member, a formed electrostatic image is easily to be disturbed. Thus, by setting a higher electrical resistance of the carrier, or causing Vpp (peak-to-peak voltage) of the developing bias to be an alternate bias voltage to be smaller, the transfer amount of the charge is further required to be suppressed.

Here, when causing the VPP of the developing bias to be smaller, although the charge injection via the carrier from the developer bearing member is reduced, the electric field to be exerted on the developer is weakened. Therefore, the force of separating the toner from the carrier is decreased, and thus developability will be reduced. Consequently, to make an image formation of high image quality, it is advantageous to set the electrical resistance of the carrier to be higher.

However, when the electrical resistance of the carrier is made to be higher, the developability, that is the capability of the toner being separated (discharged) from the carrier is found to be likely to decrease.

As described above, the carrier of the two-component developer serves to carry the toner to the developing portion, as well as to provide a charge with respect to the toner by the frictional electrification. Therefore, the carrier is provided with the charge of an opposite polarity to the charging polarity of the toner to be charged. For example, when the toner is charged to be of a negative polarity, the carrier is provided with the charge of a positive polarity.

On this occasion, in case where the electrical resistance of the carrier is high, since the electric charge having been charged in the carrier is hard to transfer, the charge of this carrier and the charge of the toner are attracted each other to be a large attractive force, and thus the toner becomes hard to be separated from the carrier. In case where the electrical resistance of the carrier is low, since the charge in the carrier is likely to diffuse on the surface of the carrier, the attractive force between the toner and the carrier becomes small, and thus the toner comes to be easily separated from the carrier.

FIG. 2 illustrates the difference in developability in the case of using two kinds of conventionally general carriers of different electrical resistance characteristics (low resistance carrier A, high resistance carrier B). In FIG. 2, the abscissa axis represents a peak-to-peak voltage Vpp of the developing bias, and the ordinate axis represents a charge amount per a unit area Q/S [C/cm$^2$] of a toner layer of a toner image formed on the photosensitive member. This Q/S [C/cm$^2$] takes a value obtained by multiplying a charge amount Q/M [μC/g] per a unit weight of the toner of the toner layer on the photosensitive member when obtaining the highest density by a toner bearing amount M/S [mg/cm$^2$] of this toner layer. The above-mentioned Q/S [C/cm$^2$] shows the developability of the developer that is how much of the toner overcomes the attractive force between the carrier and the toner, to be transferred onto the photosensitive member.

Incidentally, FIG. 2 illustrates results in the case of using an OPC photosensitive member of a film thickness (thickness of the photosensitive layer) of 30 μm as a photosensitive member.

FIG. 2 shows that in the case of a large developing bias Vpp, even in the case of high-resistance carrier B, Q/S [C/cm$^2$] equal to that of the low-resistance carrier A can be obtained. Whereas, in the case where the Vpp of the developing bias is low, the electric field for separating the toner from the carrier comes to be small, and thus the developability is found to decrease in the case of the high-resistance carrier B. That is, the attractive force between the toner and the carrier of forces to be exerted on the toner comes to be remarkably large, resulting in the reduction in developability.

In addition, the developability is largely affected by the capacitance of the photosensitive member. When the developability is reduced exceeding the permissible range as the capacitance (capacitance per a unit area) of the photosensitive member is increased, various defective images will be produced. Now, the capacitance of the photosensitive member and the developability will be described.

For example, the case of forming a toner image of the highest density on the following conditions will be thought. A development contrast (potential difference between an image portion potential on the photosensitive member and the DC voltage of the developing bias) Vcont=250 V, a charge amount of the toner Q/M=−30 μC/g, and a toner bearing amount M/S=0.65 mg/cm$^2$. The potential (charging potential) ΔV the toner layer of this toner image forms on the OPC photosensitive member is calculated by the following equation in the case where the film thickness of the OPC photosensitive member is 30 μm.

$$\Delta V = \frac{\varepsilon_t \varepsilon_0}{2\lambda t}\left(\frac{Q}{S}\right) + \frac{\varepsilon_d \varepsilon_0}{d}\left(\frac{Q}{S}\right)$$

where $$\left(\frac{Q}{S}\right) = \left(\frac{Q}{M}\right) \times \left(\frac{M}{S}\right)$$

where:

Q/M is a toner charge amount per a unit weight on the photosensitive member;

M/S is a toner weight per a unit area at the highest density portion on the photosensitive member;

λt is a toner film thickness at the highest density portion on the photosensitive member;

d is a film thickness of the photosensitive member;

εt is a relative permittivity of the toner layer;

εd is a relative permittivity of the photosensitive member; and

ε0 is a vacuum permittivity.

In the case of the above-mentioned conditions, Δ=243 V, and thus Vcont=250 V is charged. That is, it is in the state in which the potential of an electrostatic image is fully charged by the electric charge of the toner layer (charging efficiency of 97%).

On the other hand, an a-Si photosensitive member has material characteristics of about three times larger relative permittivity than that of the OPC photosensitive member (a-Si photosensitive member: about 10, OPC member: about 3.3). Accordingly, the a-Si photosensitive member, in the case of having the film thickness (for example, 30 μm) equal to that of the OPC photosensitive member, is to have the capacitance (for example, $2.95\times10^{-6}$ F/m$^2$), being three times the capacitance (for example, $0.97\times10^{-6}$ F/m$^2$) of the OPC photosensitive member.

Considered is the case where a toner image of the highest density is formed on the a-Si photosensitive member on the conditions of Vcont (=250 V) and the charge amount of a toner Q/M (=−30 μC/g) as with the case of the above-mentioned OPC photosensitive member. In this case, from the above-mentioned equation, the toner amount required to satisfy ΔV=250 V is 1.15 mg/cm$^2$, and thus the toner amount of about 1.7 times the toner amount in the case of the above-mentioned OPC photosensitive member is to be transferred onto the a-Si photosensitive member. Conversely, at the developing contrast Vcont of about 1/1.7, the toner bearing amount M/S=0.65 mg/cm$^2$ is to be obtained. Therefore, in the case of the a-Si photosensitive member, at about Vcont=147 V, the electric charge at the high density portion is charged.

However, e.g., in the case of entering into a light printing market, a wide range of tone is required to obtain. Therefore, in case of Vcont=147 V, γ characteristic becomes sharp, and there are some cases where a high tone is hard to obtain.

Furthermore, even in case of an OPC photosensitive member, for the purpose of the sharpness of an electrostatic image, an attempt to reduce the film thickness of the photosensitive member (thickness of the photosensitive layer) has been made. Even in this case, the capacitance of the photosensitive member is increased as the film thickness of the photosensitive member is decreased, the same problems as are described in the above-mentioned a-Si photosensitive member may occur.

To address such problems resulted from a large relative permittivity of the photosensitive member or a small film thickness of the photosensitive member, a method of increasing Q/S [C/cm$^2$] of the toner layer of a toner image, that is increasing the charge amount Q/M [μC/g] of the toner can be thought. For example, the toner charge amount Q/M [μC/g] is set to be −60 μC/g with respect to the above-described −30 μC/g. In this state, supposing that, for example, when the developing contrast Vcont is 240 V, a toner bearing amount M/S [mg/cm$^2$] of 0.65 mg/cm$^2$ can be obtained, ΔV the toner layer forms is to be 238 V (that is about 240 V), and thus the charging efficiency will be about 100%.

However, in actual, when the charge amount Q/M [μC/b] of the toner is increased, since the electrostatic force of the carrier and the toner comes to be exceedingly large, the developability may be largely reduced.

In normal, with respect to a photosensitive member of a large capacitance, in the case of using a high-resistance carrier and a toner of high Q/M, even at a weak electric field the high-resistance carrier forms, the toner is so controlled as to be fully separated from the carrier. That is, with the shape of the toner, an extraneous additive, and further the material of the surface of the carrier, the attractive force (Coulomb force+Van der Waals force+cross linking force) between the carrier and the toner is controlled. However, when the state of the surface of the toner or the carrier is changed due to the performance over a long period, the above-mentioned attractive force may not be controlled.

For example, the toner is extraneously added with a variety of particles (e.g., silica) for controlling a charge amount or fluidity. This extraneous additive also functions as a spacer particle between the toner and the carrier, and largely affects the attractive force between the toner and the carrier. Therefore, for example, in the case where an image output at a low printing ratio continues over a long period, a developer is repeatedly exerted with a shearing force in the developing device, the extraneous additive is embedded in or separated from the surface of the toner, and thus the above-described effect as a spacer may be reduced. As a result, the attractive force between the toner and the carrier will be largely increased. Accordingly, after the image output over a long period, as compared with an initial case, a sufficient developability cannot be ensured, resulting in the possibility of producing e.g., defective images.

For example, in some developers used, while initially M/S=0.65 mg/cm$^2$ has been ensured at the Vcont=240 V, due to the performance with time, only M/S=0.45 mg/cm$^2$ can be obtained at the Vcont=240 V. In this case, the charging potential ΔV with respect to the Vcont is 152 V/240 V≈0.63, that is the potential ΔV the toner layer on the photosensitive member forms just charges about 63% of the Vcont.

Such state in which the potential of an electrostatic image is not charged with the electric charge of the toner can be referred to as "charge failures". When in this state of "charge failures", defective images will be produced.

For example, in the case where after the formation of a half-tone image of a low density, a solid image of a high density (image at the highest image density level) is continuously output, when the potential on the side of the high density portion in the developing portion (developing nip) is not charged with the electric charge of the toner, at the boundary portion, a wrap-around electric field from the low-density portion to the high-density portion remains. Since this wrap-around electric field acts to cause the toner on the low-density side to move to the high-density side at the boundary, the so-called "blank area" is generated. That is, "blank are" is the phenomenon that an image comes to be white at the boundary between the low-density portion and the high-density portion. In addition, at the high-density portion, due to the difference between electric field intensities at the edge portion and at the central portion, the so-called "sweep together" phenomenon that the toner is collected at the edge occurs. That is, "sweep together" is the phenomenon that the density at the edge of an image comes to be higher than that at the other portions.

As described above, in the case of a photosensitive member of a low surface resistance, for example, like an a-Si photosensitive member, to faithfully develop an electrostatic image to be formed, desired is a carrier of an electrically high resistance with which no charge injection occurs with respect to the electrostatic image in development. Whereas, with respect to a photosensitive member of a large capacitance such as an a-Si photosensitive member or a thin-film OPC photosensitive member, the increase of the charge amount Q/M [μC/g] of the toner is an effective way for obtaining a sufficient tone with stability without producing defective images such as blank area. However, when the charge amount Q/M [μC/g] of the toner is made higher, developability may be largely reduced. This reduction of developability becomes remarkable as the electrical resistance of the carrier is increased.

With the arrangement, in an image forming apparatus employing a two-component developer including a toner and a carrier, there are some cases where the electrical resistance of the carrier is set to be high in order to prevent the charge injection into an electrostatic image in development, and the charge amount of the toner is increased in order to deal with a photosensitive member of a large capacitance. Furthermore, even in this case, it is desirable not to reduce the developability of the toner charging the potential of the electrostatic image.

SUMMARY OF THE INVENTION

An object of the present invention, in an image forming apparatus using a two-component developer including a toner and a carrier, is to provide an image forming apparatus enabling to obtain a good developability while controlling a charge injection into an electrostatic image via the carrier.

Another object of the present invention is to provide an image forming apparatus having a development method of dramatically improving the developability even in the case of using the toner of a high charge amount while using a high-resistance carrier.

Another object of the present invention is to provide an image forming apparatus enabling the formation of an image of high definition as well as with stability over a long period even in the case of using a photosensitive member of a large capacitance.

Another object of the present invention is to provide an image forming apparatus in which carrier resistance characteristics based on the change of an electric field between an image bearing member and a developer bearing member are properly set.

Further features of the present invention will become apparent from the following description of exemplary embodiments with reference to the attached drawings.

DETAILED DESCRIPTION OF THE PREFERRED EMBODIMENTS

Figure 1:
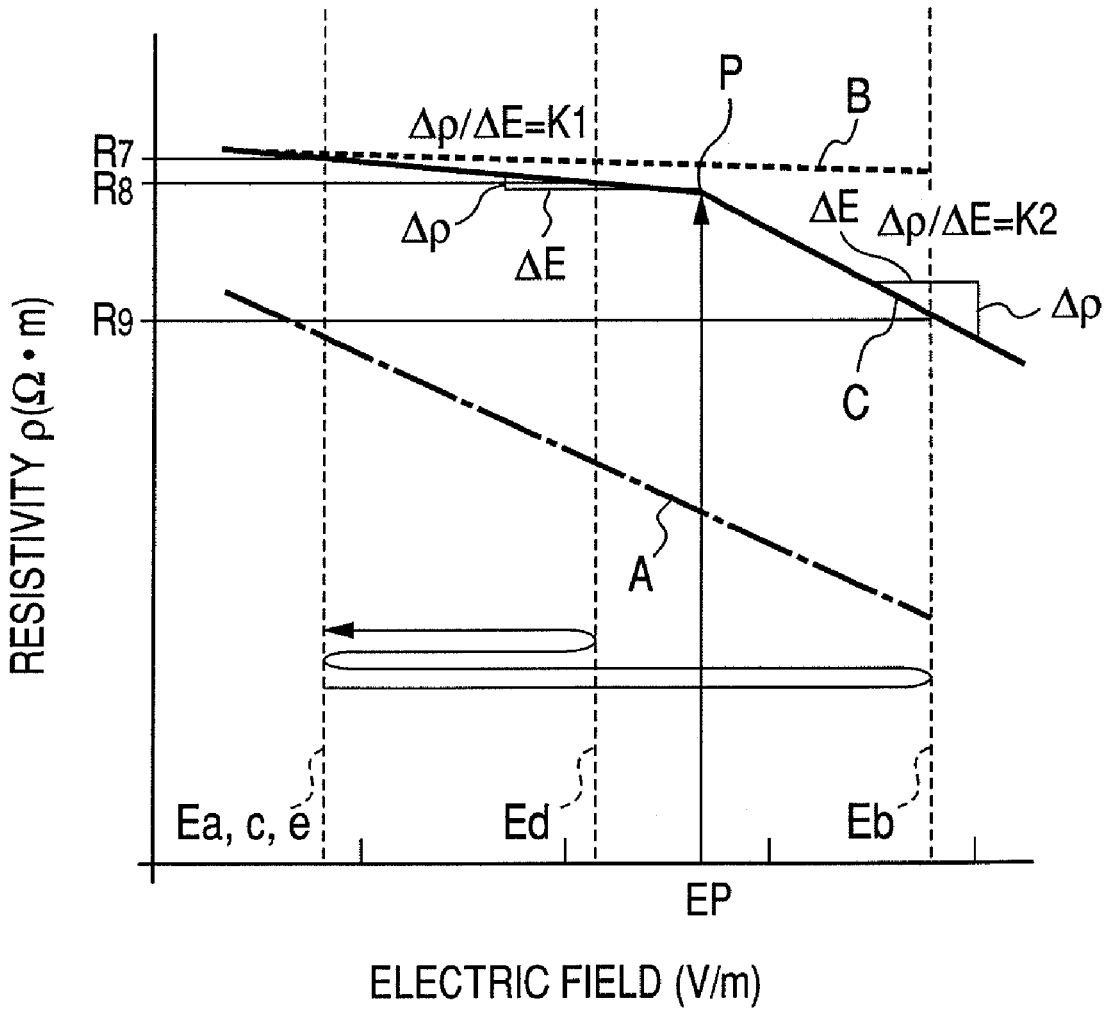
FIG. 1 is a graph for illustrating the fluctuation of the resistivity of a carrier in the application of a developing bias.

Hereinafter, an image forming apparatus according to the present invention will be described in more detail referring to the drawings.

Embodiment 1

Image Forming Apparatus

Figure 24:
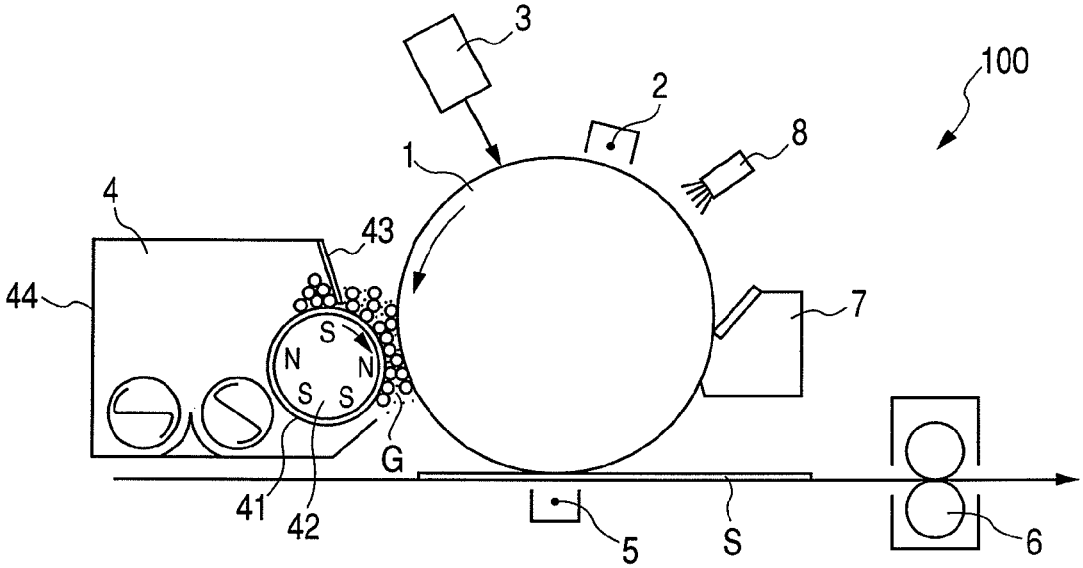
FIG. 24 is a schematic sectional construction diagram of one embodiment of image formation to which the present invention is applicable.

FIG. 24 illustrates a schematic sectional construction of a principal portion of an image forming apparatus 100 according to one exemplary embodiment of the present invention.

The image forming apparatus 100 includes a cylindrical photosensitive member (photosensitive drum) 1 acting as an image bearing member. Around the photosensitive member 1, there are disposed a charger 2 acting as a charging unit, an exposure device 3 acting as an exposure unit, a developing device 4 acting as a developing unit, a transfer charger 5 acting as a transfer unit, a cleaner 7 acting as a cleaning unit, an pre-exposure device 8 acting as a pre-exposure unit, and the like. In addition, there is located a fixing device 6 acting as a fixing unit downstream of a transfer portion where the photosensitive member 1 and the transfer charger 5 are in opposition in a conveying direction of a recording sheet S.

As the photosensitive member 1, generally an OPC photosensitive member, or an a-Si photosensitive member can be employed.

Figure 25:
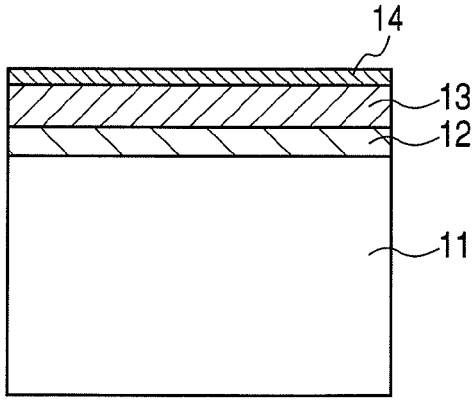
FIG. 25 is a schematic view for illustrating one example of a layer construction of the photosensitive member.

An OPC photosensitive member is formed of a photosensitive layer (photosensitive film) provided with a photoconductive layer which main component is an organic photoconductor on a conductive base. The OPC photosensitive member, in general, as illustrated in FIG. 25, is formed of a laminate of a charge generation layer 12 made of an organic material, a charge transport layer 13, an a surface protecting layer 14 on a metal base (support for a photosensitive member) 11.

Figure 26A:
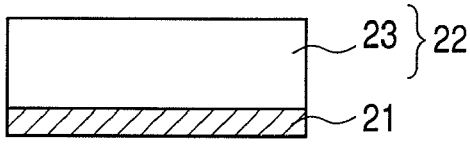
FIGS. 26A, 26B, 26C, and 26D are schematic views for illustrating other examples of the layer construction of the photosensitive member.
Figure 26B:
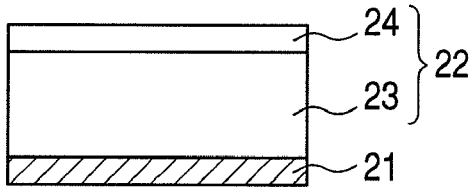
Figure 26C:
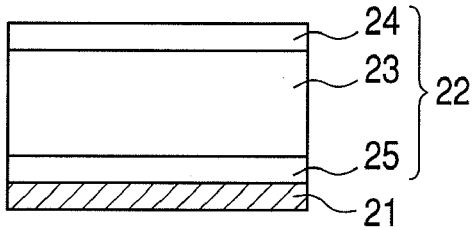
Figure 26D:
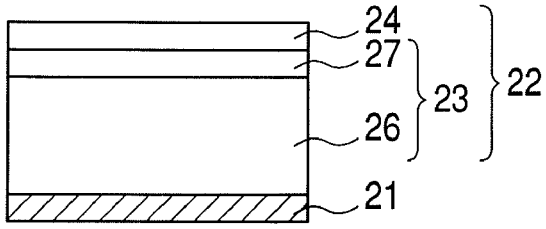

Furthermore, an a-Si photosensitive member includes a photosensitive layer (photosensitive film) provided with a photoconductive layer which main component is non-crystalline silicon (amorphous silicon) on a conductive base. The a-Si photosensitive member generally possesses the following layer constructions. That is, the a-Si photosensitive member illustrated in FIG. 26A is provided with a photosensitive film 22 on a support (base) 21 for the photosensitive member. This photosensitive film 22 is formed of a photoconductive layer 23 that is made of a-Si: H, X (H is a hydrogen atom, and X is a halogen atom) and that has photoconductive properties. The a-Si photosensitive member illustrated in FIG. 26B is provided with a photosensitive film 22 on the support 21 for the photosensitive member. This photosensitive film 22 is formed of a photoconductive layer 23 that is made of a-Si; X, X and that has photoconductive properties, and an amorphous silicon surface layer 24. The a-Si photosensitive member illustrated in FIG. 26C is provided with a photosensitive film 22 on the support 21 for the photosensitive member. This photosensitive film 22 is formed of a photoconductive layer 23 that is made of a-Si: H, X and that has photoconductive properties, an amorphous silicon surface layer 24, and an amorphous silicon charge injection blocking layer 25. The a-Si photosensitive member illustrated in FIG. 26D is provided with a photosensitive film 22 on the support 21 for the photosensitive member. This photosensitive film 22 is formed of a charge generation layer 26 and a charge transport layer 27 that are made of a-Si: H, X to make up a photoconductive layer 23, and an amorphous silicon surface layer 24.

Incidentally, the photosensitive member 1 is not limited to those of the above-described layer constructions, but can employ a photosensitive member of the other layer construction.

The photosensitive member 1, as illustrated in FIG. 24, is driven to rotate at a predetermined circumferential speed in the direction indicated by the arrow in FIG. 24. The surface of the photosensitive member 1 in rotation is substantially uniformly charged by means of the charger 2. Then, in a position opposed to the exposure device 3, this surface of the photosensitive member 1 is irradiated with a laser to be emitted corresponding to an image signal from the exposure device 3 and formed with an electrostatic image corresponding to a document image on the photosensitive member 1.

The electrostatic image having been formed on the photosensitive member 1, when having reached the position opposed to the developing device 4 by the rotation of the photosensitive member 1, is developed as a toner image with a two-component developer provided with nonmagnetic toner particles (toner) and magnetic carrier particles (carrier) in the developing device 4. The electrostatic image is developed substantially only with a toner of the two-component developer.

The developing device 4 includes a developing container (developing device main body) 44 containing the two-component developer. Moreover, the developing device 4 includes a developing sleeve 41 acting as a developer bearing member. The developing sleeve 41 is located rotatably in an opening of the developing container 44, as well as contains a magnet 42 acting a magnetic field generation unit in an internal part. In this embodiment, the developing sleeve 41 is driven to rotate so as to move in the same direction as the moving direction of the surface of the photosensitive member 1 at a developing portion G where the surface thereof is opposed to the photosensitive member 1. The two-component developer, after having been bore on the surface of the developing sleeve 41, is regulated in amount by a regulating member 43, and carried to the developing portion G opposed to the photosensitive member 1. A carrier serves to bear a charged toner to carry it to the developing portion G. In addition, the toner, by being mixed with the carrier, is charged to be of a predetermined amount of charge of a predetermined polarity due to a frictional electrification. The two-component developer on the developing sleeve 41, at the developing portion G, is napped by a magnetic field the magnet 42 generates to form a magnetic brush. Then, in this embodiment, this magnetic brush is brought in contact with the surface of the photosensitive member 1, and the developing sleeve 41 is applied with a predetermined developing bias, thereby causing only the toner of the two-component developer to be transferred to an electrostatic image on the photosensitive member 1.

The toner image having been formed on the photosensitive member 1 is transferred electrostatically onto the recording sheet S by the transfer charger 5. Thereafter, the recording sheet S is conveyed to the fixing device 6, and heated and pressurized here, whereby the toner is fixed onto the surface thereof. Thereafter, the recording sheet S is discharged out of the apparatus as an output image.

Incidentally, the toner remaining on the photosensitive member 1 after a transfer process is removed by means of the cleaner 7. Thereafter, the photosensitive member having been cleaned by means of the cleaner 7 is electrically initialized by the irradiation of light from the pre-exposure device 8, and the above-mentioned image forming operation is repeated.

[Electrical Resistance of Carrier]

As described above, in an image forming apparatus using a two-component developer containing a toner and a carrier, there are some cases where to prevent a charge injection into an electrostatic image in development, an electrical resistance of the carrier is set to be high, and to be applied to a photosensitive member of a large capacitance, the charge amount of the toner is made larger. Even in these cases, it is desirable not to reduce a developability of the toner charging the electric potential of the electrostatic image.

Thus, an object of the present invention is to propose a development method of tremendously improving developability even in the case of employing a toner of a high charge amount while using a high resistance carrier. Furthermore, another object of the present invention, with the arrangement, is to enable the formation of an image of high definition as well as with stability over a long period even in the case of using a photosensitive member of a large capacitance.

Then, in this embodiment, the electric field dependence of an electrical resistance of the carrier under a developing bias is controlled. Hereinafter, detailed descriptions will be made.

Figure 3:
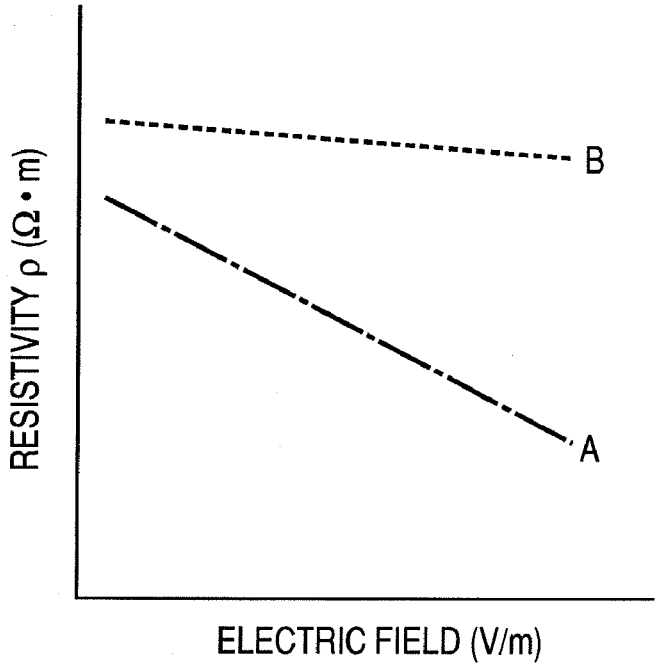
FIG. 3 is a graph for illustrating the fluctuation of the resistivity of the carrier in the application of the developing bias.

FIG. 3 illustrates the electric field dependence of a resistivity ρ [Ω·m] of conventionally general two kinds of carriers (a low-resistance carrier A, a high-resistance carrier B) of different electrical resistance characteristics. In FIG. 3, the abscissa axis represents an electric field [V/m], and the ordinate axis represents a resistivity ρ [Ω·m]. It is, however, a semilogarithmic graph in which the ordinate axis is on a logarithmic scale (it is the axis of logarithm). Hereinafter, likewise, in the graph of the resistivity ρ, a numerical value is logarithmic.

Figure 4:
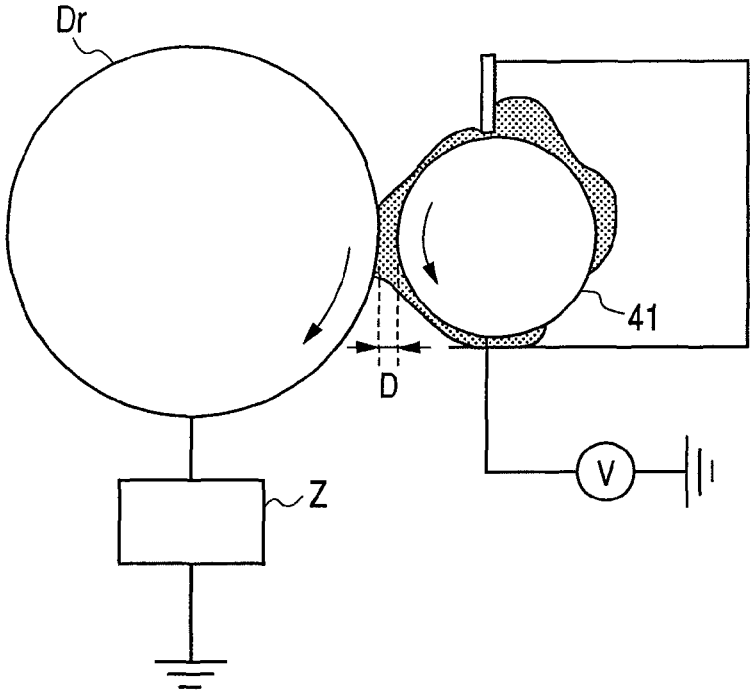
FIG. 4 is a schematic view for illustrating a measurement method of the resistivity of the carrier.

Incidentally, the resistivity ρ [Ω·m] can be measured by using an apparatus as illustrated in FIG. 4. That is, with respect to a cylinder Dr that is made of aluminum (hereinafter referred to as "aluminum drum") in rotation at a predetermined circumferential speed (surface movement speed), the developing sleeve 41 containing therein only a carrier is made to be opposed with a predetermined distance (closest distance) spaced. Then, while the developing sleeve 41 is being rotated at a predetermined circumferential speed, an AC voltage is applied to between the aluminum drum Dr and the developing sleeve 41, and the impedance of the carrier is measured by means of an impedance measuring device illustrated with Z in FIG. 4. From a measured value thereof, the resistivity of the carrier can be calculated.

Incidentally, it is preferable that the circumferential speed of the aluminum drum Dr and the circumferential speed of the developing sleeve be the same as the circumferential speed of the photosensitive drum and the circumferential speed of the developing sleeve of an actual image forming apparatus respectively. Further, it is preferable that the distance between the aluminum drum Dr and the developing sleeve be the distance between the photosensitive drum and the developing sleeve of the actual image forming apparatus.

In addition the electric field E [V/m] on the abscissa axis is an electric field intensity in the closest position of the aluminum drum Dr and the developing sleeve 41 (closest distance D between the aluminum drum Dr and the developing sleeve 41), and is the one that is obtained by dividing the applied voltage between the aluminum drum Dr and the developing sleeve 41 by the distance D.

In FIG. 3, the line indicated by a one-dot chain line illustrates an electric field dependence of the resistivity of the low-resistance carrier A, and the line indicated by a broken line illustrates an electric field dependence of the high-resistance carrier B. Incidentally, each carrier is the one which resistivity at the time of the application of a bias of approximately 100 V is as follows.

low resistance carrier A: about $9.0\times10^{6}\Omega\cdot m$ high resistance carrier B: about $1.0\times10^{8}\Omega\cdot m$ From FIG. 3, although both of the carriers have the electric field dependence of the resistivity (that is, as the electric field is increased, the resistivity is decreased), the low-resistance carrier A is found to have a larger gradient (rate of change) of the electric field dependence thereof than that of the high-resistance carrier B. The above-mentioned gradient of both the low-resistance carrier A and the high-resistance carrier B is substantially constant, that is a straight line with respect to the change of an electric field to be applied to the carrier.

Incidentally, the above-described resistivity of the carrier is a measurement result only with the carrier. When in the state of a two-component developer of being mixed with the toner, since there is present the toner of a high electrical resistance between the carriers, it will be a rather large resistivity as compared with the above-described resistivity of only the carrier. In a development operation, however, due to that the toner is separated from the carrier nearly to be in the state in which only the carrier is present, the resistivity having been measured as described above substantially shows the actual state. Therefore, in this specification, descriptions will be made using the resistivity of only the carrier having been measured as described above.

Figure 5:
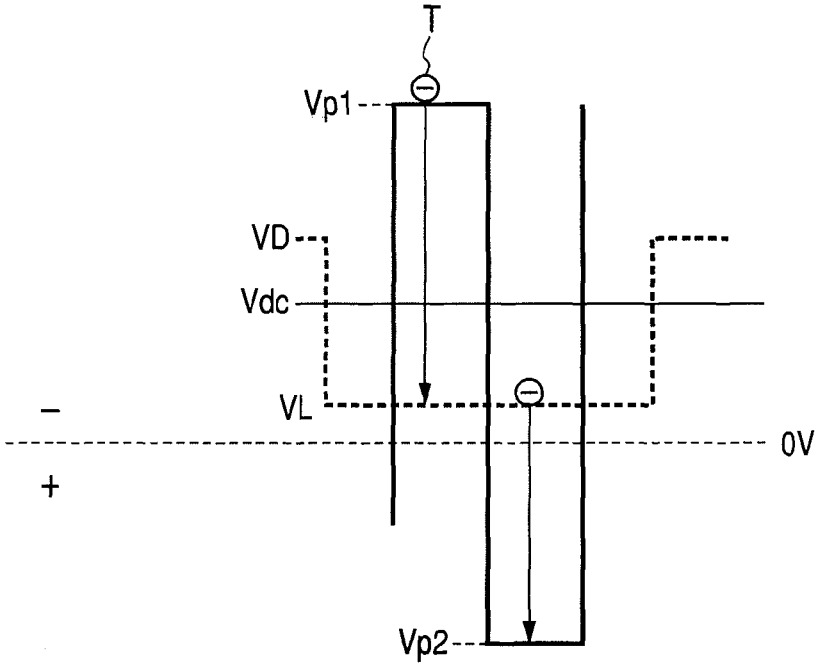
FIG. 5 is an explanatory chart for illustrating the relationship between the developing bias and the potential of an electrostatic image.

FIG. 5 illustrates the potential of an electrostatic image on the photosensitive member 1 and the developing bias to be applied to the developing sleeve 41 in a development operation. In FIG. 5, the abscissa axis represents a time, and the ordinate axis represents a potential.

In this embodiment, as a developing bias, a developing bias of general rectangular waves (alternate voltage) is used. This developing bias is a developing bias in which a DC bias component indicated by Vdc is superimposed on an AC bias. This developing bias is applied between the electrostatic image on the photosensitive member 1 and the developing sleeve 41.

Incidentally, in this embodiment, an electrostatic image will be described to be formed by an image exposure method forming the electrostatic image by exposing an image portion. Furthermore, in this embodiment, the photosensitive member 1 is described to be charged at a negative polarity. Moreover, this embodiment is described as the one in which the toner is charged to be of a negative polarity due to the frictional electrification between the toner and the carrier; and a development method employs a reversal development method (developing an image portion having been exposed on the photosensitive member) of using the toner that is charged to be of the same polarity as the charging polarity of the photosensitive member.

In FIG. 5, VD is the charging potential of the photosensitive member 1, and in this embodiment, is charged to be of a negative polarity by the charging unit. In FIG. 5, VL is the region of the image portion having been exposed by the exposure unit, and has the potential for obtaining the highest density. That is, the VL potential portion is the region in which the adhesive amount of a toner T becomes the largest.

Onto the developing sleeve 41, the developing bias of rectangular waves is applied as described above. Therefore, when a Vp1 potential of peak potentials is applied to the developing sleeve 41, the largest potential difference is formed with respect to the VL potential portion, and in the electric field provided by this potential difference (hereinafter, it is referred to as "developing electric field.), the toner T is transferred to the photosensitive member 1. Moreover, on the contrary, when a Vp2 potential of peak potentials is applied to the developing sleeve 41, with respect to the VL potential, the potential difference in the opposite direction to that when the developing electric field is formed, and the electric field in which the toner T is pulled back from the VL potential portion to the developing sleeve 41 side (hereinafter, it is referred to as "pullback electric field"). With the arrangement, the developing sleeve that is applied with the developing bias forms an alternate electric field with respect to the VL potential portion. Furthermore, the developing sleeve that is applied with the developing bias forms an alternate electric field with respect to the VD potential portion as well.

Figure 6:
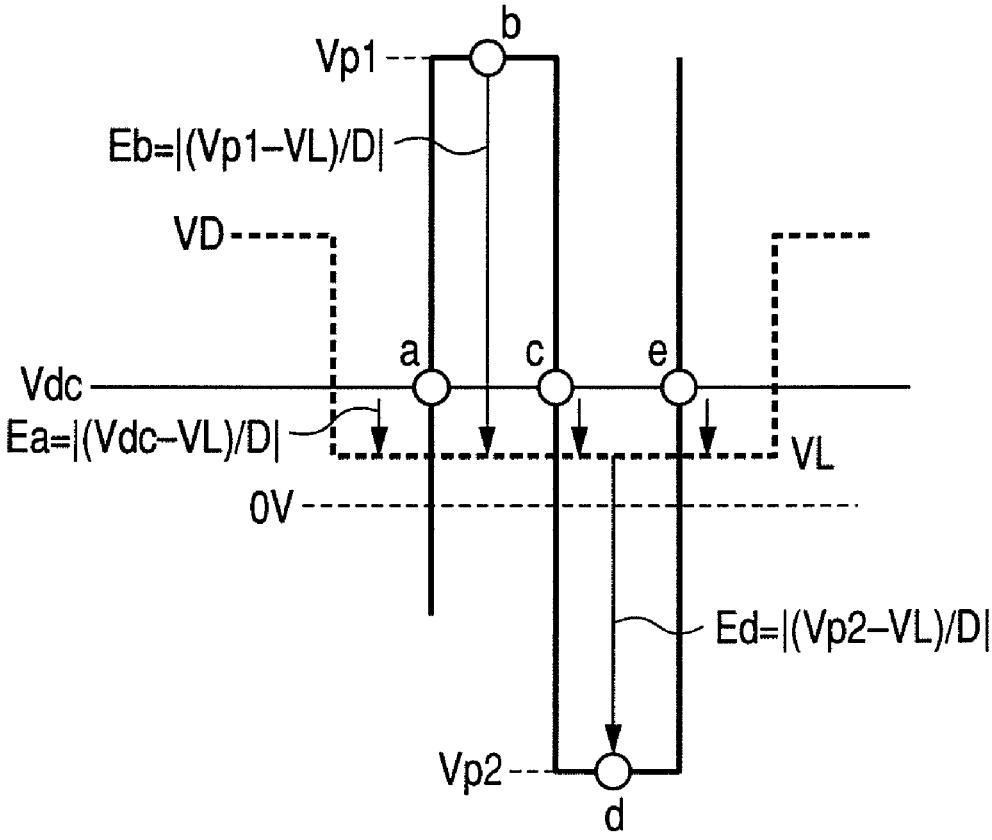
FIG. 6 is an explanatory chart for illustrating the relationship between the developing bias and the potential of an electrostatic image.

Here, with reference to FIG. 6, as to the temporal change with respect to the VL potential of the developing bias, electric fields Ea, Eb, Ec, and Ed at respective time points a, b, c, d, and e illustrated in FIG. 6 are expressed by the following equations.

$$Ea=Ec=Ee=|(Vdc-VL)/D|$$

$$Eb=|(Vp1-VL)/D|$$

$$Ed=|(Vp2-VL)/D|$$

where:

VL is the potential [V] of an electrostatic image for obtaining the highest density;

Vp1, of peak potentials of an alternate voltage, is a peak potential [V] providing such a potential difference as to move the toner toward the photosensitive member with respect to the VL potential;

Vp2, of peak potentials of an alternate voltage, is a peak potential [V] providing such a potential difference as to move the toner toward the developer bearing member with respect to the VL potential;

Vdc is a DC bias component [V] of the developing bias; and

D is the closest distance [m] between the photosensitive member 1 and the developing sleeve 41.

Incidentally, Vp1 and Vp2 are expressed by the following equations depending on the charge polarity of the toner.

In the case where a toner is of a negative polarity: Vp1=Vdc−|Vpp/2|

In the case where a toner is of a positive polarity: Vp1=Vdc+|Vpp/2|

In the case where a toner is of a negative polarity: Vp2=Vdc+|Vpp/2|

In the case where a toner is of a positive polarity: Vp2=Vdc−|Vpp/2| where: Vpp is a peak-to-peak voltage at an alternate voltage; and Vdc is a DC bias component of the developing bias.

That is, the electric fields Ea, Ec and Ee are the ones obtained by dividing the potential difference between the DC bias of the developing bias and the potential at the highest density portion [VL potential] of an electrostatic image on the photosensitive member 1 by the distance D in the closest position of the photosensitive member 1 and the developing sleeve 41. The electric field Eb (developing electric field) is the one that is obtained by dividing the potential difference between the peak potential providing the potential difference of forming an electric field on the side of moving the toner toward the photosensitive member 1 with respect to the VL potential on the photosensitive member 1, and the VL potential on the photosensitive member 1 by the closet distance D of the photosensitive member 1 and the developing sleeve 41. In addition, the electric field Ed (pullback electric field) is the one that is obtained by dividing the potential difference between the peak potential providing the potential difference of forming an electric field on the side of moving the toner toward the developing sleeve 41 with respect to the VL potential on the photosensitive member 1 and the VL potential by the closest distance D between the photosensitive member 1 and the developing sleeve 41.

Figure 7:
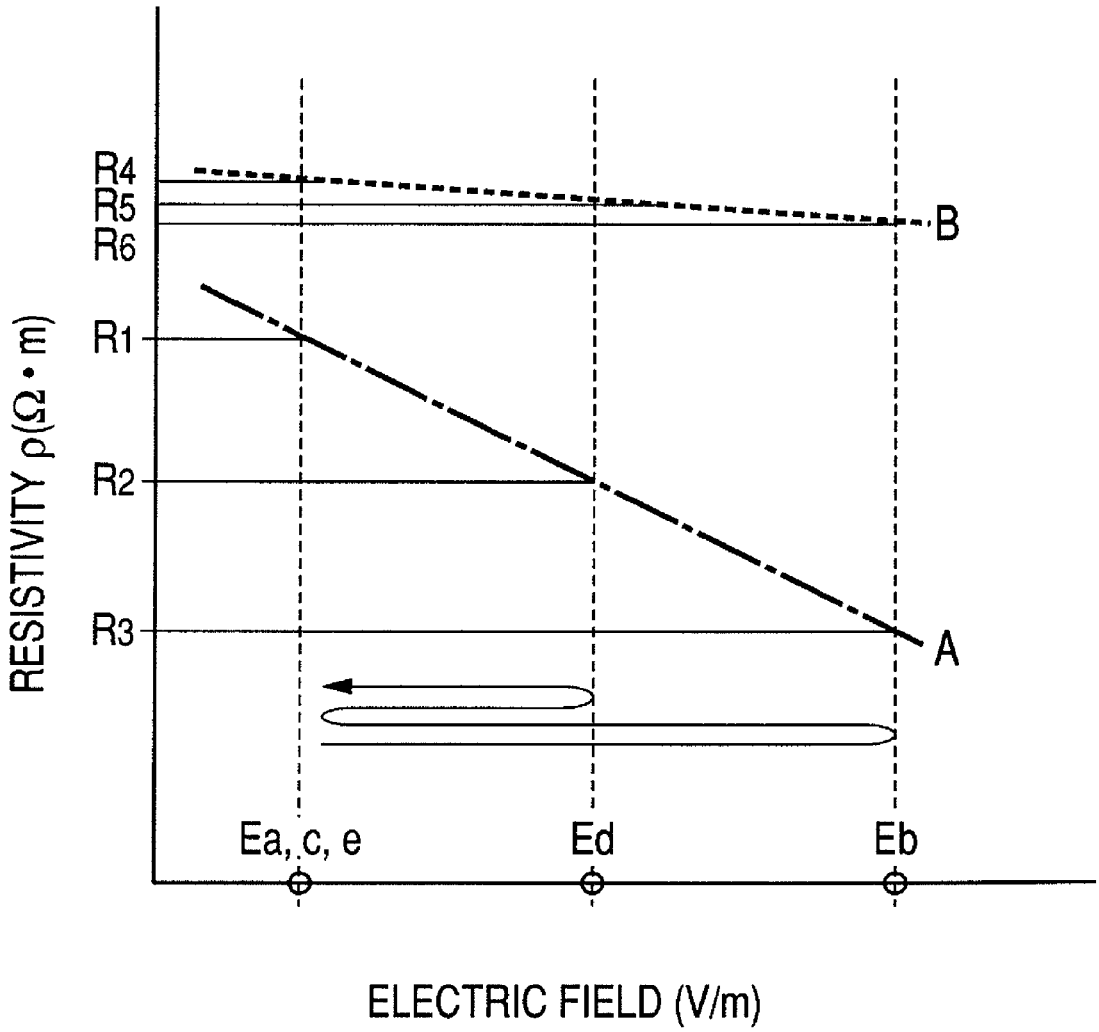
FIG. 7 is a graph for illustrating the fluctuation of the resistivity of a carrier in the application of the developing bias.

On the other hand, as described referring to FIG. 3, the resistivity of the carries has the electric field dependence. Therefore, as illustrated by the arrow in FIG. 7, under the developing bias, as an electric field intensity is changed to be Ea→Eb→Ec→Ed→Ee, the resistivity of the carriers will be changed. Thus, for example, in the case of a low-resistance carrier A, the resistivity thereof is changed to be R1→R3→R1→R2→R1; and in the case of a high-resistance carrier B, the resistivity thereof is changed to be R4→R6→R4→R5→R4.

Figure 8:
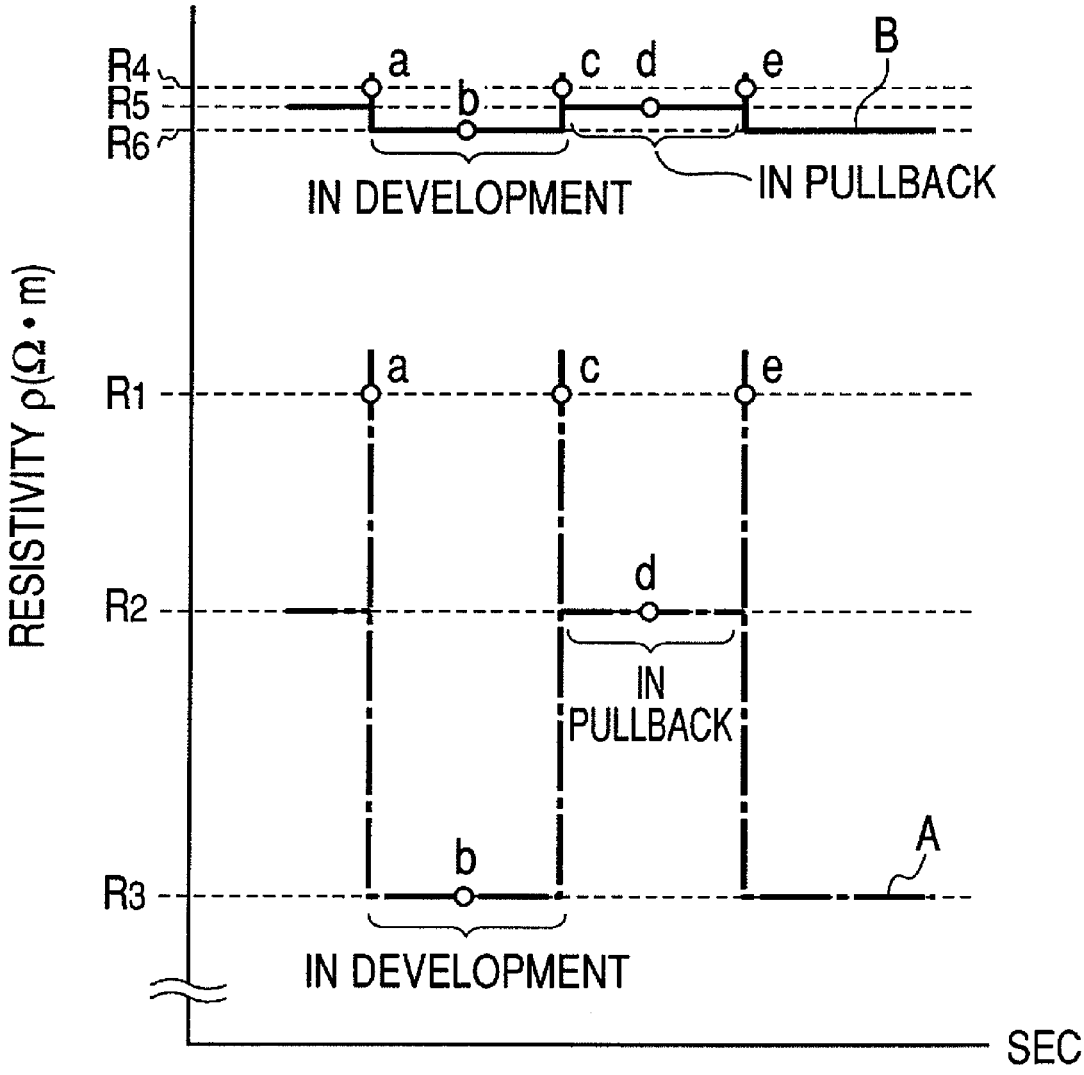
FIG. 8 is a chart for illustrating the fluctuation of the resistivity of the carrier with respect to the change of time under the developing bias.

The change of this resistivity over time will be plotted as illustrated in FIG. 8.

That is, in the case of the low-resistance carrier A, the resistivity of the carrier when the developing electric field is applied is a lower resistivity R3. Whereas, in the case of the high-resistance carrier B, the resistivity of the carrier when the developing electric field is applied is approximately a higher R6. That is, the rate of decrease of the resistivity of the carrier when the developing electric field is applied is small in the case of the high-resistance carrier B as compared with the low-resistance carrier A. This difference affects the charge transfer in the carrier to be the difference in developability.

Here, in FIG. 1, the electric field dependence of the resistivity of a carrier C according to this embodiment (hereinafter, merely referred to as "carrier C".). As seen from FIG. 1, as with the case of the low-resistance carrier A and the high-resistance carrier B as a comparative example, although the resistivity of the carrier C has the electric field dependence, the case of the carrier C has characteristics of the gradient (rate of change) of the electric field dependence of the resistivity thereof being sharp at a predetermined electric field Ep.

That is, in the case of the carrier C, the resistivity ρ thereof has an gradient (Δρ/AE) with respect to the change of an electric field intensity E (=ΔV/D), being a value that is obtained by dividing a potential difference ΔV between the potential of the developing sleeve 41 and the potential of an electrostatic image on the photosensitive member 1 by the closest distance D of the photosensitive member 1 and the developing sleeve 41. Furthermore, in the case of the carrier C, the gradient (Δρ/ΔE) of the electric field dependence of the resistivity ρ is changed at the electric field intensity Ep in the relationship of Ed<Ep<Eb.

Incidentally, the gradient (rate of change) of the electric field dependence of the resistivity of the carrier is represented by the gradient of the relationship between a resistivity and an electric field intensity to be substantially a linear relationship in the case where this resistivity is plotted on the ordinate axis of a semilogarithmic graph (axis of logarithm), and the electric field intensity is plotted on the abscissa axis.

In addition, in the carrier C, in the case where the gradient (Δρ/AE) of the electric field dependence of the resistivity ρ in the electric field intensity Ed is to be K1, and the gradient (Δρ/ΔE) of the electric field dependence of the resistivity ρ in the electric field intensity Eb is to be K2, the relationship of 0≧K1>K2 holds. That is, when K1 is not 0, K1 and K2 are of the same sign (here, negative).

Thus, as illustrated in FIG. 1, when the carrier C is applied with the above-described developing bias, as the electric field intensity is changed to be Ea→Eb→Ec→Ed→Ee, the resistivity of the carrier is changed to be R7→R9→R7→R8→R7.

Figure 9A:
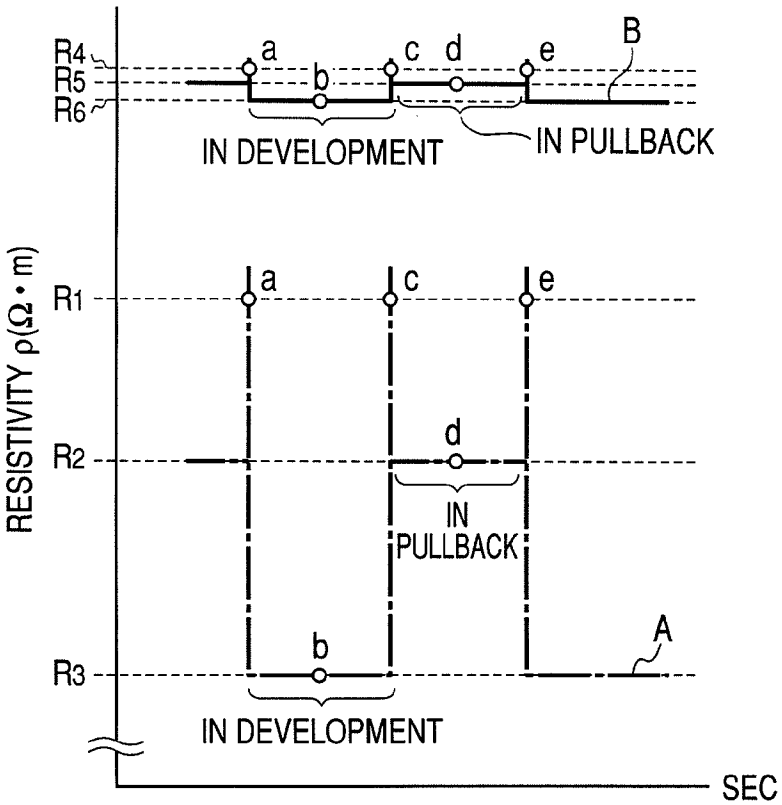
FIGS. 9A and 9B are charts for illustrating the fluctuation of the resistivity of the carrier with respect to the change of time under the developing bias.
Figure 9B:
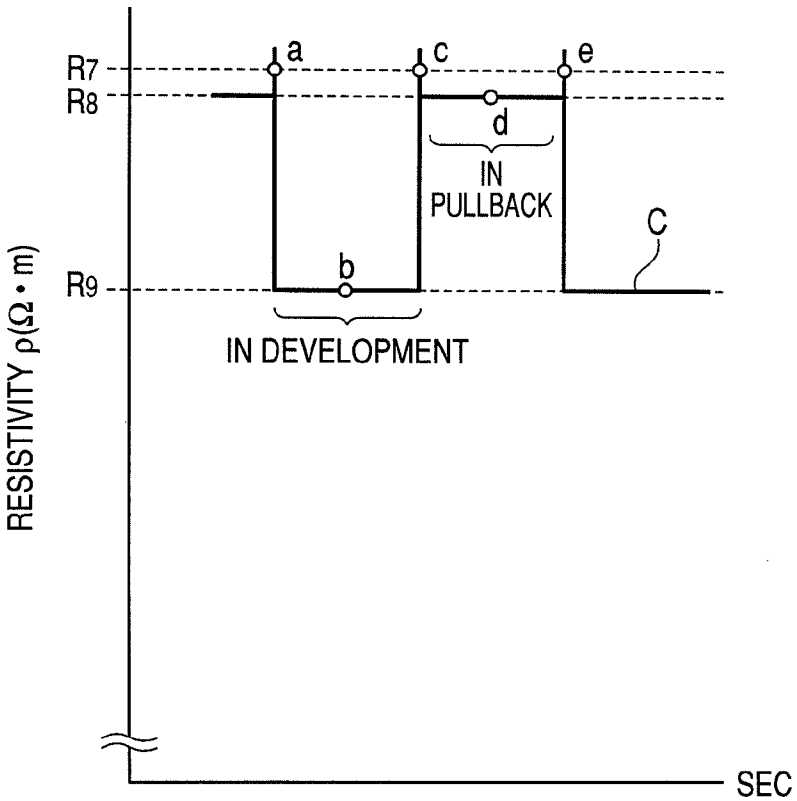

The graph in which the change of the resistivity of this charier C is plotted with respect to the change of time is as illustrated in FIG. 9B. FIG. 9A illustrates the change of the resistivity of the carrier A and the carrier B as is in FIG. 8.

That is, the resistivity of the carrier C becomes a lower resistivity R9 during the application of a developing electric field Eb, and on the contrary, is kept to be a higher resistivity R8 during the application of a pullback electric field Ed.

In the case of the carrier C, only when the developing electric field Eb is formed, the resistivity thereof is sharply decreased, the reverse charge having been charged in the carrier is likely to diffuse, and thus an attractive force between the toner and the carrier is decreased. Therefore, the toner is more likely to be separated from the carrier than in the case of the high-resistance carrier B.

On the contrary, when the pullback electric field Ed is formed, the resistivity of the carrier is increased, so that the charge is less likely to be transferred, thus to be in the state in which the charge of the opposite polarity hardly flows from the developing sleeve 41 side to the carrier. Therefore, there is not much reverse charge in the carrier. Thus, in the case where the pullback electric field is applied, the toner will be less likely to be pulled back from the photosensitive member 1 to the carrier again, and caught.

With the arrangement, in the case of the carrier C, the electrical resistance is decreased only when the developing electric field Eb is applied, and thus developability is ensured as with the low-resistance carrier A. Whereas, when the pullback electric field Ed is applied, a high electrical resistance is kept, and thus the pullback force is weakened. As a result, the developability comes to be totally improved further than the high-resistance carrier B.

Now, the action of the carrier C as to a charge injection to disturb the potential of an electrostatic image on the photosensitive member 1 will be described. Here, descriptions will be made taking as an example the charge injection in the case of employing an a-Si photosensitive member as the photosensitive member 1.

Figure 10:
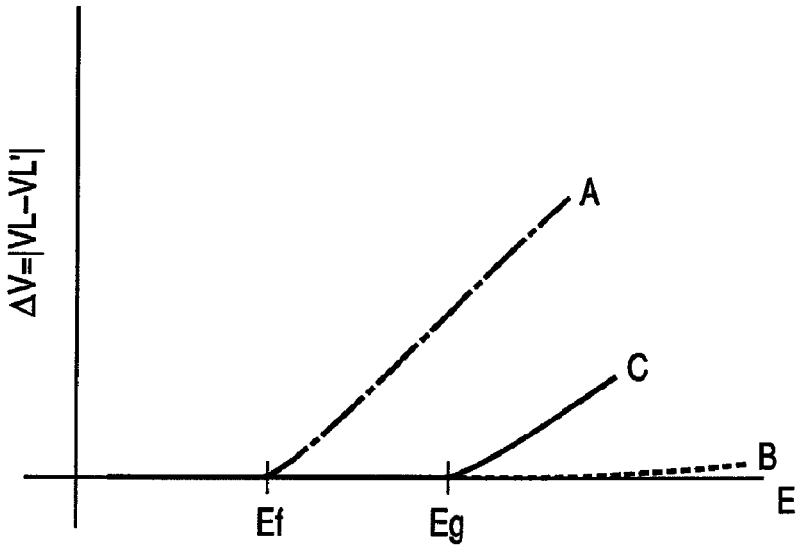
FIG. 10 is a graph illustrating results of the examination of a charge injection amount in development into the photosensitive member.

FIG. 10 illustrates the amounts of charge injection with respect to the VL potential in the case of the carriers A, B, and C. In FIG. 10, the abscissa axis represents an electric field E to be formed between the potential of the developing sleeve 41 and the VL potential on the photosensitive member 1, and the ordinate axis represents the difference between the VL potential and the potential VL' after charge injection at this VL potential portion, that is |VL−VL'|.

Figure 11:
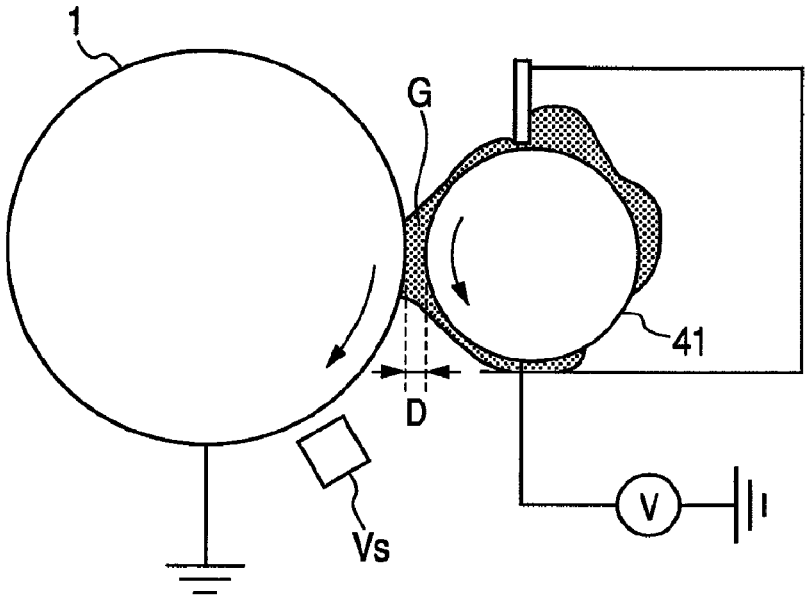
FIG. 11 is a schematic view for illustrating a measurement method of a charge injection amount.

Here, VL' and VL, as illustrated in FIG. 11, are measured by means of a surface electrometer Vs downstream of the developing portion G in the moving direction of the surface of the photosensitive member 1. The potential that is measured in the absence of the developing device 4 is defined as VL (equivalent to the above-described VL potential), and the VL potential in the case where the developing device 4 is located, and a predetermined developing bias is applied is defined as VL'.

That is, FIG. 10 schematically illustrates how much the potential is changed due to the charge injection from the carrier that is in contact with this VL potential portion when the VL potential passes the developing portion G.

FIG. 10 indicates that the charge injection is started at an electric field Ef in the case of the low-resistance carrier A, and the charge injection is started at an electric field Eg in the case of the carrier C.

Figure 12:
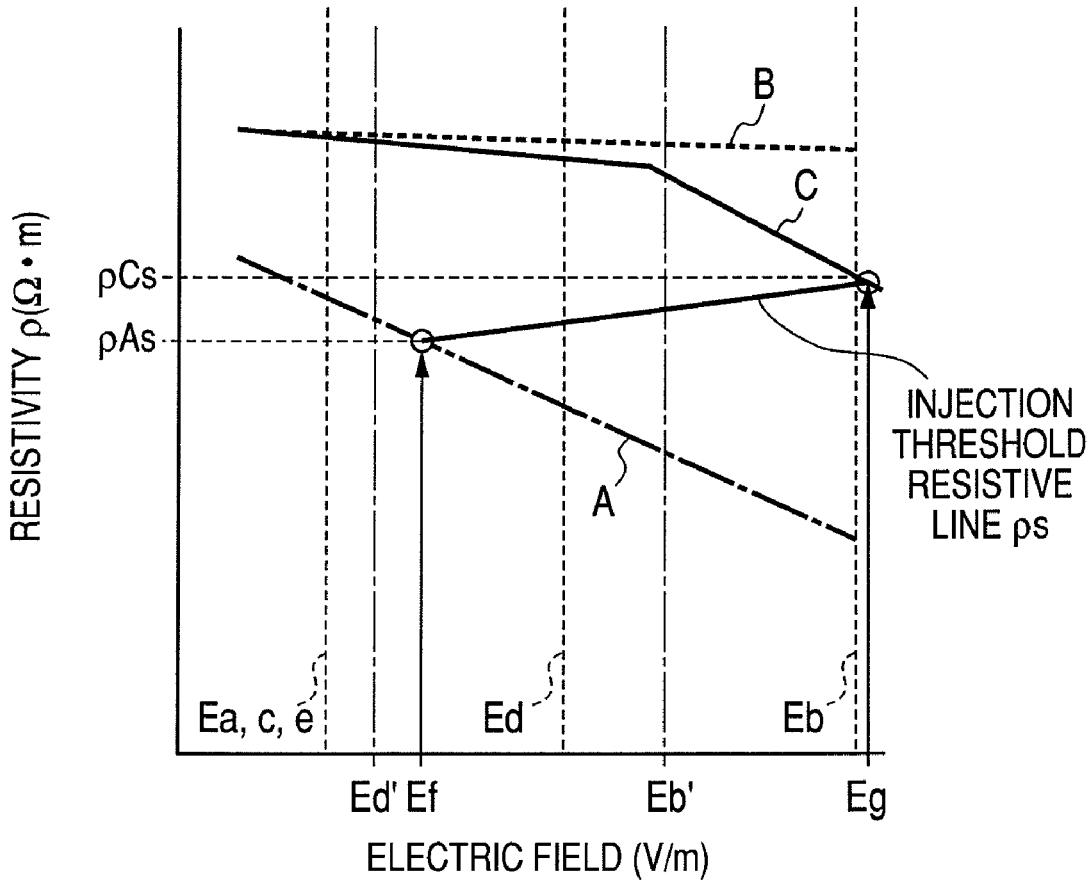
FIG. 12 is a graph for illustrating the fluctuation of the resistivity of the carrier and a charge injection threshold in the application of the developing bias.

When the resistivity of the carriers at these electric fields Ef and Eg is obtained from the graph of FIG. 1, as illustrated in FIG. 12, the resistivity of the carrier A at the electric field Ef is ρAs, and the resistivity of the carrier C at the electric field Eg is ρCs.

Furthermore, in case of letting the line connecting the plot Ef, ρAs and the plot Eg, ρCs an injection threshold resistive line ρs, the resistivity of the carrier less than this injection threshold resistive line ρs means that the charge injection into the photosensitive member occurs.

Here, in comparison between the electric fields Ef and Eg, and the developing electric field Eb and the pullback electric field Ed, the carrier A is in the relationship of Ef<Ed, Ef<Eb. Therefore, the charge injection is found to occur both in development and in pullback.

Whereas, the carrier C is in the relationship of Eg>Ed, Eg>Eb. Therefore, the charge injection occurs neither in development nor in pullback.

Here, it is assumed that in the case of the carrier A, such a pullback electric field Ed' and developing electric field Eb' as to hold the relationship of, for example, Ed<Ef<Eb is selected. Even in this case, although no charge injection occurs in the pullback electric field Ed', the charge injection will occur in the developing electric field Eb' as well.

Figure 13A:
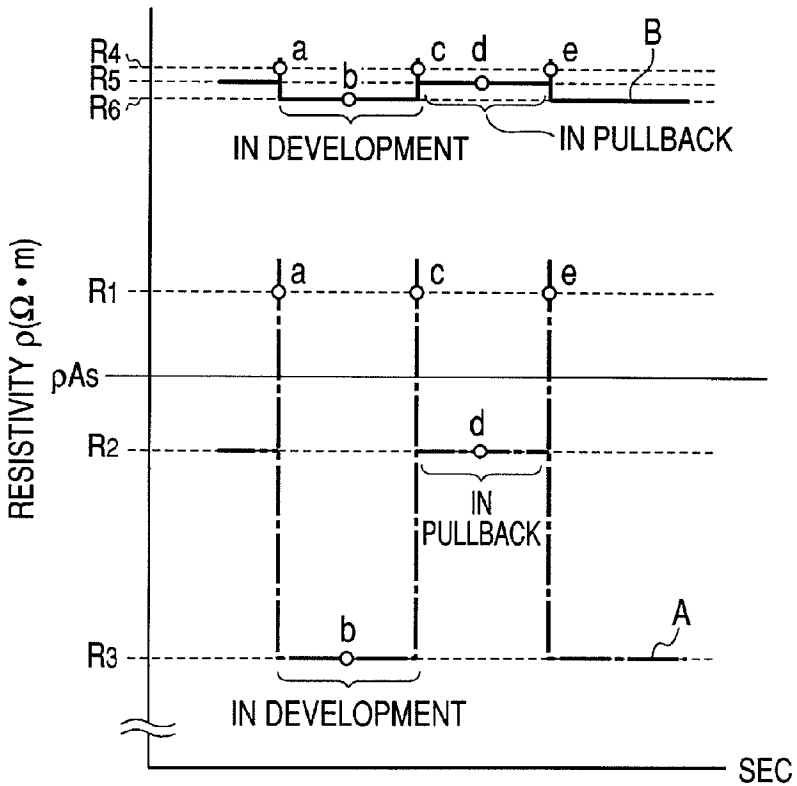
FIGS. 13A and 13B are charts for illustrating the fluctuation of the resistivity of the carrier and the charge injection threshold with respect to the change of time under the developing bias.
Figure 13B:
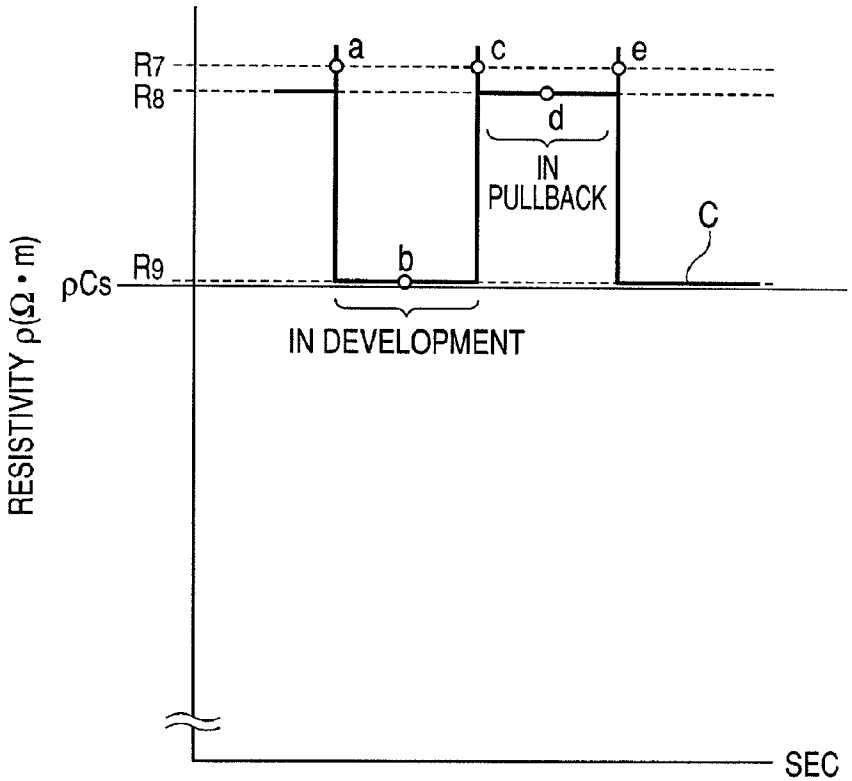

FIGS. 13A and 13B are what the line indicating the resistivities ρAs and ρCs is superimposed on FIGS. 9A and 9B. For example, in the case of the low-resistance carrier A, when the developing electric field Eb and the pullback electric field Ed are applied, since the resistivity of the carrier is less than ρAs in FIG. 13A, that is, below the injection threshold resistive line ρs, the charge injection occurs with respect to the potential of the electrostatic image of VL. Whereas, in the case of the carrier C, since the resistivity of the carrier is more than ρCs in the electric fields Eb and Ed that is above the injection threshold resistive line ρs no charge injection occurs.

As a result, by using the carrier having resistive characteristics of this embodiment, no charge injection from the carrier to the electrostatic image occurs, whereby there is no rise of the VL potential, thus enabling to suppress a lower image density.

Heretofore, electrical resistive characteristics of the carrier C are schematically described. By having electrical resistive characteristics as is the above-described carrier C, while preventing the charge injection into an electrostatic image via the carrier, being a problem in the case of using a conventional low-resistance carrier, as compared with the case of using a conventional high-resistance carrier, developability can be tremendously improved. That is, by the use of the carrier having the above-described arrangement, the developability of the toner of a high charge amount can be greatly improved. Furthermore, even with a photosensitive member of a large capacitance, the image formation of high definition as well as with stability can be enabled.

Hereinafter, advantages of this embodiment will be described in further detail based on a more specific test example.

Example 1

To confirm the advantage of this embodiment, a comparative evaluation is made using a conventional low-resistance carrier A and high-resistance carrier B, as well as a carrier C according to this embodiment.

Low-Resistance Carrier A:

Examples of the low-resistance carrier A include the ones which core material employs magnetite or ferrite having magnetic properties expressed by the following formula (1) or (2)

$$MO.Fe_2O_3 \quad (1)$$

$$M.Fe_2O_4 \quad (2)$$

in the formula, M expresses a trivalent, divalent or monovalent metallic ion.

Examples of the M include Be, Mg, Ca, Rb, Sr, V, Cr, Mn, Fe, Co, Ni, Cu, Zn, Y, Zr, Nb, Mo, Cd, Pb and Li. These compositions can be used alone or in combination.

Examples of a specific compound of metallic compound particles having the above-mentioned magnetic properties include ferrous oxides such as Cu—Zn—Fe ferrite, Mn—Mg—Fe ferrite, Mn—Mg—Sr—Fe ferrite, and Li—Fe ferrite.

The manufacturing method of ferrite particles can adopt the known methods, which include, for example, the following method. That is, a ferrite composition having been ground is mixed with a binder, water, a dispersion, an organic solvent and the like, to form particles by a spray dryer method or a flow granulation method. Thereafter, they are burned at a temperature in the range of 700 degrees C. to 1400 degrees C., preferably 800 degrees C. to 1300 degrees C. in a rotary kiln or a batch-type baking furnace. Subsequently, the resulting product is screened and classified to control a particle size distribution, to be core material particles for a carrier. Furthermore, the ferrite particle surface is coated with resin such as a silicone resin at about 0.1% to 1.0% by mass by a dipping method.

The carrier having been manufactured in such a way is referred to as a low-resistance carrier A herein.

High-Resistance Carrier B:

Examples of the high-resistance carrier B include the following ones.

First, it is the one in which a magnetic substance dispersion-type resin carrier that is manufactured by fusing and kneading magnetite particles and a thermoplastic resin and grinding it, is used as a core material. Second, it is the one in which a magnetic substance dispersion-type resin carrier that is manufactured by spray drying with the use of e.g., a spray dryer a slurry of magnetite particles and a thermoplastic resin being fused and dispersed in a solvent, is used as a core material. Third, it is the one in which a magnetic substance dispersion-type resin carrier that is manufactured by cure-reacting phenol by a direct polymerization in the presence of magnetite particles and hematite particles, is used as a core material. These core materials of the carrier are further coated with a resin such as a thermoplastic resin about at 1.0% to 4.0% by mass using a fluidized-bed coating apparatus and the like.

The carrier having been manufactured in such a way is referred to as a high-resistance carrier B herein.

Carrier C According to this Embodiment:

On the other hand, as the carrier C according to this embodiment, for example, used can be a porous resin-filled carrier in which resin such as a silicone resin is made to flow in a porous core, and spaces in the core are filled with the resin.

Manufacturing methods of such carrier C include the following method. First, a predetermined amount of such metal oxides, ferric oxides (Fe2O3) and additives as used in the above-mentioned low-resistance carrier A are weighed and mixed. Examples of the above-mentioned additives can include oxides containing at least one element of the elements belonging to IA, IIA, IIIA, IVA, VA, IIIB and VB groups of the periodic table, for example, BaO, AI2O3, TiO2, SiO2, SnO2 and Bi2O5. Then, the mixture having been obtained is calcinated for five hours in the range of 700 degrees C. to 1000 degrees C., and thereafter ground to be of a particle diameter of about 0.3 μm to 3 μm. The ground product having been obtained is mixed with a binding agent and further a blowing agent as necessary, spray-dried under the heated atmosphere at 100 degrees C. to 200 degrees C., and granulated to be of the size of about 20 μm to 50 μm. Subsequently, the resulting product is burned for 8 hours to 12 hours at a sintering temperature of 1000 degrees C. to 1400 degrees C. under the atmosphere of an inactive gas (for example, N2 gas) of not more than 5% of an oxygen concentration. Whereby, a porous core is obtained. Then, this porous core is filled with a silicone resin at 8% to 15% by mass by the dipping method, and this silicone resin is cured in the atmosphere of an inactive gas at 180 degrees C. to 220 degrees C.

In the above-described manufacturing method, by controlling the porous level of the core, as well as the electrical resistance of the core itself, further the amount of resin such as a silicone resin to be filled and the like, the electric field dependence of the resistivity of the carrier such as an inflection point, an gradient K1, K2, and the resistivity at the time of the application of an electric field Eb, Ed can be controlled.

By the above-mentioned control, in an internal part of the carrier C, an insulating portion and a conductive portion can be mixed in a desired state, and thus the charge amount flowing through the carrier can be controlled. For example, as is the carrier A, in the case of a carrier in which the entire core is formed of a conductive material, when a developing bias is applied, an electrical path is likely to be formed in the carrier and between the carriers, and thus the resistance value is to be sharply decreased. However, in an internal part of the carrier C according to the present invention, since the spaces of the porous core are filled with resin, it is constructed that the flow of the charge is blocked to some extent at this resin portion. Therefore, when the developing bias is applied, there is no occurrence of sharp resistance decrease, and thus in a desired electric field intensity, the resistance can be decreased.

Figure 27:
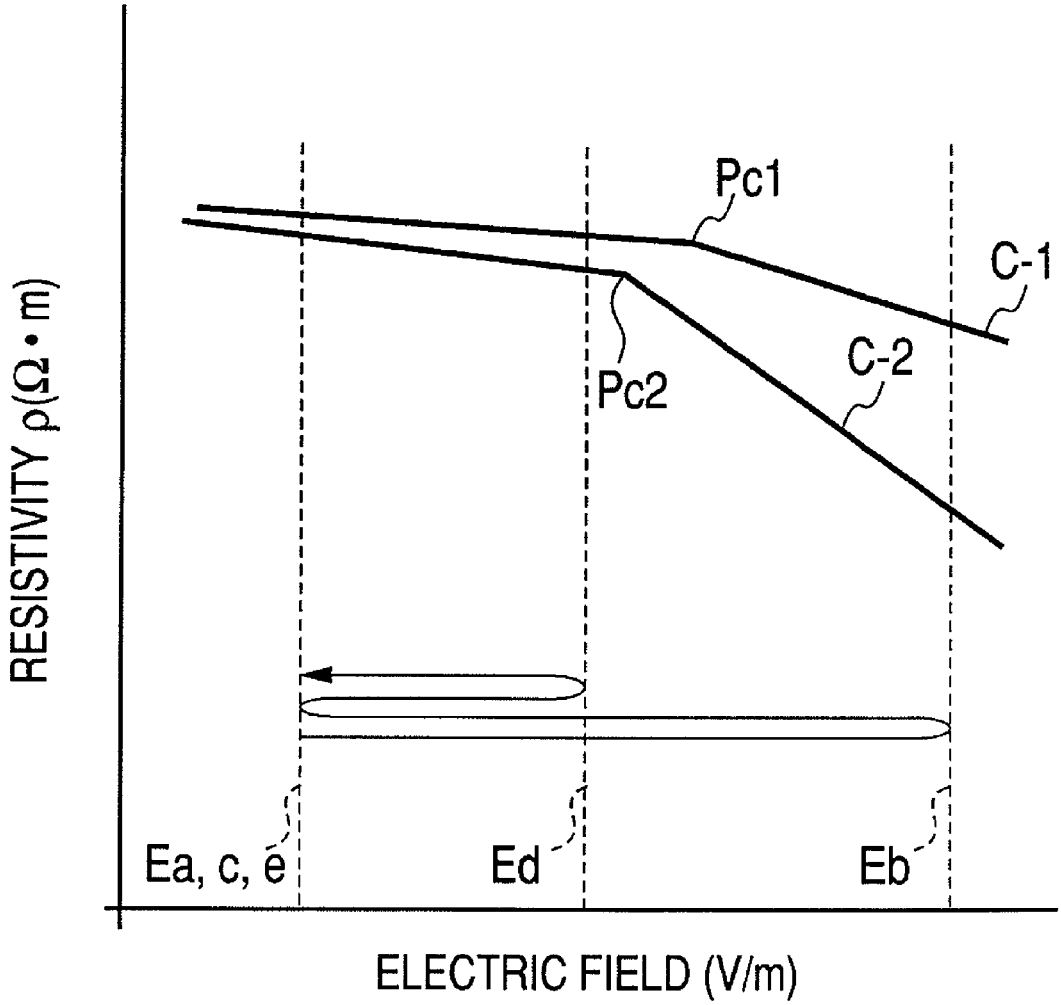
FIG. 27 is a graph for illustrating the difference in the fluctuation of the resistivity depending on the kind of the carrier according to the present invention.

Furthermore, the porous level or the resistance value of the core can be controlled by controlling the above-described blowing agent amount as well as the inactive gas concentration for controlling firing environments and the sintering temperature. For example, the resistivity of the carrier that is manufactured on the conditions illustrated in the following table 1 will be illustrated in FIG. 27.

TABLE 1

| Carrier manufacturing conditions | | |
|---|---|---|
| | C-1 | C-2 |
| Oxygen concentration | 1.0% | 0.5% |
| Sintering temperature | 1200° C. | 1250° C. |
| Blowing agent amount | 5% | 3% |

The carrier C-1, by decreasing the sintering temperature as well as increasing the blowing agent amount, is controlled such that the porous level is made higher, and the resin amount to be filled is made larger. By filling a more resin, the resistance value can be increased. Furthermore, by causing the oxygen concentration for controlling the firing environment to be higher, the resistance value of the core can be increased.

Whereas, the carrier C-2, by increasing the sintering temperature as well as decreasing the blowing agent amount, is controlled such that the porous level is made lower and the resin amount to be filled is made smaller. In case of a small amount of resin to be filled, the resistance value can be decreased. Furthermore, by causing the oxygen concentration for controlling the firing environment, the resistance value of the core can be decreased.

With the arrangement, by the manufacturing control in each process, desired inflection point as well as K1 and K2 can be obtained.

Figure 14:
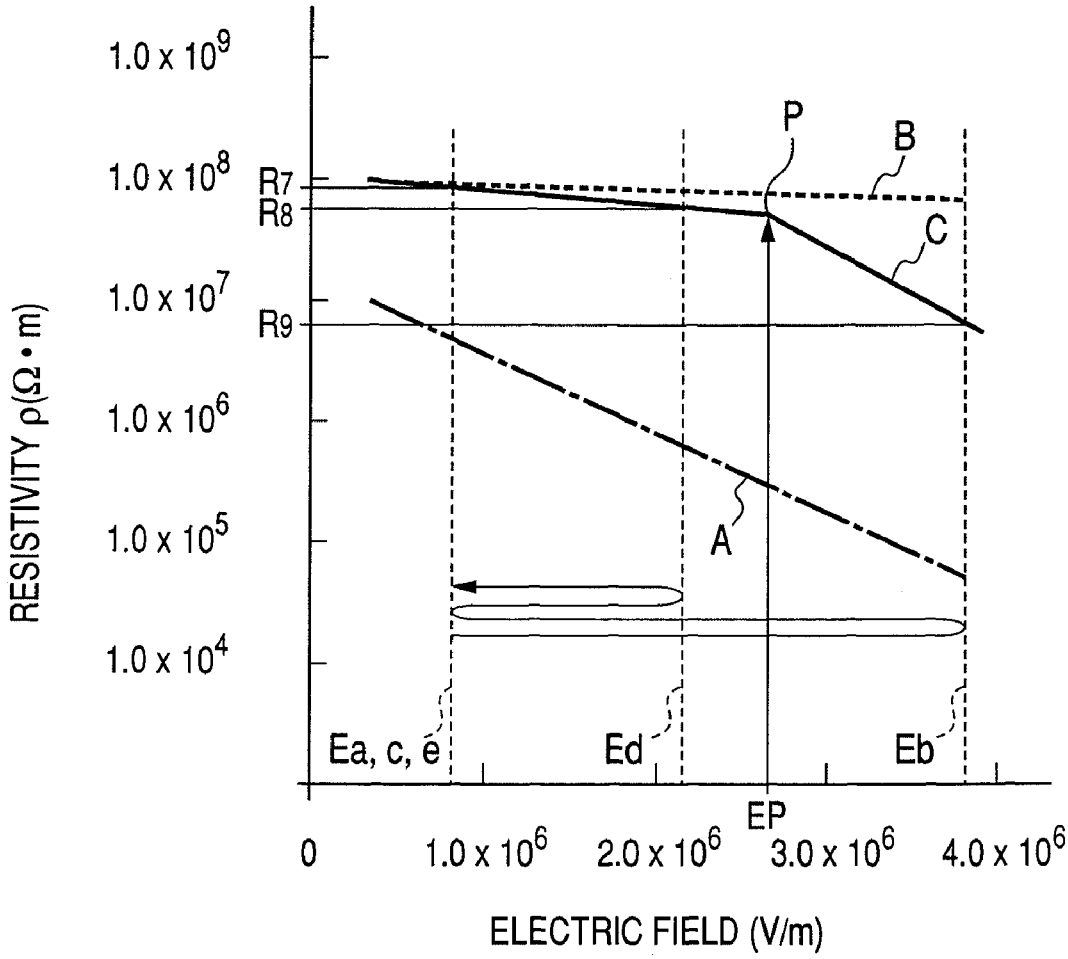
FIG. 14 is a graph for illustrating the fluctuation of the resistivity of the carrier in the application of the developing bias in a test example.

Comparative Evaluation:

FIG. 14 illustrates the electric field dependence of the resistivity of the low-resistance carrier A, the high-resistance carrier B, and the carrier C. Each of the low-resistance carrier A, the high-resistance carrier B and the carrier C has the electric field dependence of the resistivity. Generally, as the electric field is increased, the resistivity is decreased.

The resistivity ρ of each carrier is to be measured by using the apparatus illustrated in FIG. 4. That is, with respect to an aluminum drum Dr in rotation at a circumferential speed (surface movement speed) of 300 mm/sec, the developing sleeve 41 of the developing device 4 that is filled with only a carrier is made to be opposed with a distance (closest distance) of 300 μm spaced. Then, while rotating the developing sleeve 41 at the circumferential speed of 540 mm/sec, an AC voltage was applied between the aluminum drum Dr and the developing sleeve 41 to make an impedance measurement of the carrier. Thus, the resistance value R of the carrier was obtained from this measured value. On this occasion, the impedance measurement was made using 126096W manufactured by Solartron Corporation as an impedance measuring equipment Z. In addition, an area S where the aluminum drum Dr and the carrier are in contact was measured, and the resistivity ρ of the carrier was obtained from the following equation.

$$R = \rho\left(\frac{D}{S}\right) \qquad \text{Equation 2}$$

Furthermore, an electric field E on the abscissa axis is an electric field intensity in the closest position (closest distance D) of the aluminum drum Dr and the developing sleeve 41, and is the one obtained by simply dividing the applied voltage between the aluminum drum Dr and the developing sleeve 41 by a distance D.

Figure 15:
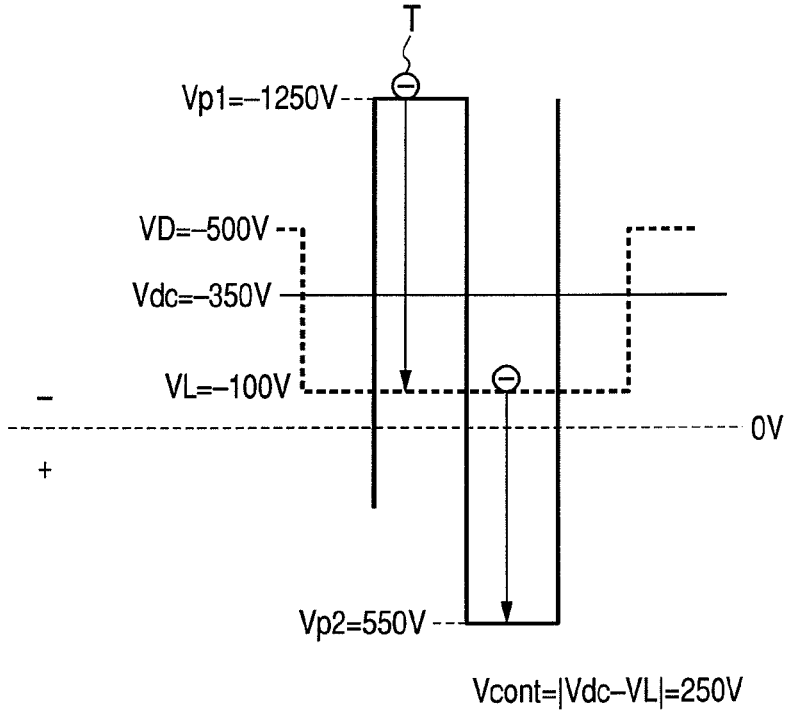
FIG. 15 is an explanatory chart for illustrating the relationship between the developing bias and the potential of the electrostatic image in the test example.

FIG. 15 illustrates the potential of an electrostatic image on the photosensitive member 1 and the developing bias to be applied to the developing sleeve 41 in an actual development operation. In FIG. 15, the abscissa axis represents a time, and the ordinate axis represents a potential.

In this example, a developing bias employs a developing bias (alternate voltage) of rectangular waves of a peak-to-peak voltage Vpp=1.8 kV, a DC component Vdc=−350 V, and a frequency f=12 KHz (one cycle is 83.3 μsec). This developing bias is applied to the developing sleeve 41.

In this example, an electrostatic image is formed by an image exposure method. Moreover, in this example, a toner is charged to be of a negative polarity by a frictional electrification between the toner and the carrier. A development method employs the reversal development method.

In FIG. 15, VD is a charging potential (dark-portion potential) of the photosensitive member 1, and in this example, is charged to be −500 V by means of the charger 2. In FIG. 15, VL is the potential (light-portion potential) at an image portion that is exposed by the exposure device 3, and is set to be −100 V, being the potential for obtaining the highest density.

The developing sleeve 41 is applied with a developing bias of rectangular waves as described above. Therefore, when Vp1 potential=−1250 V is applied, the largest potential difference (=1150 V) is formed with respect to VL potential=−100 V. Further, at the developing electric field that is formed by this potential difference, the toner is separated form the carrier. In addition, when Vp2 potential=+550 V is applied to the developing sleeve 41, the potential difference of 650 V is formed with respect to the VL potential (=−100 V), and thus the pullback electric field in which the toner is pulled back to the developing sleeve 41 side from the VL potential portion is formed.

Figure 16:
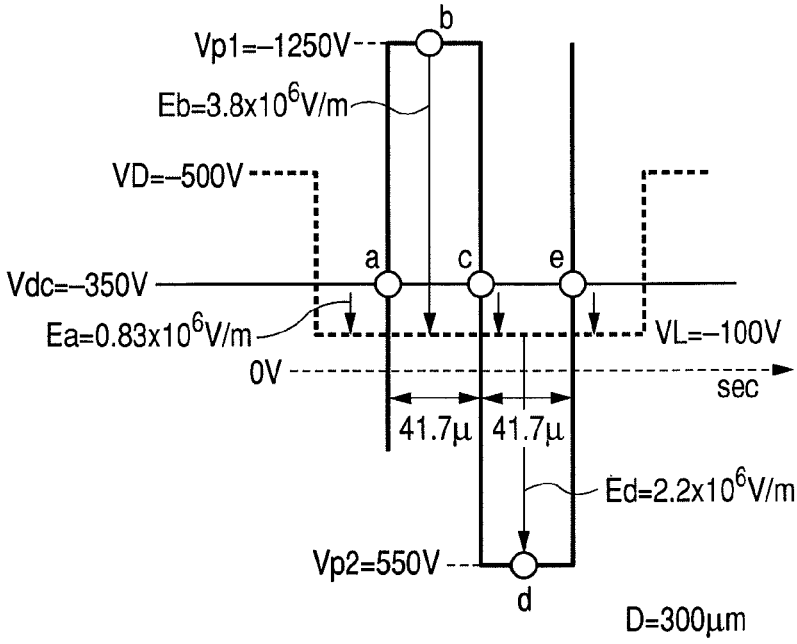
FIG. 16 is an explanatory chart for illustrating the relationship between the developing bias and the potential of the electrostatic image in the test example.

Referring to FIG. 16, as to the temporal change of the developing bias with respect to the VL potential, electric fields Ea, Eb, Ec, Ed, and Ee at each time point of a, b, c, d, and e are to be calculated with the following equations respectively. Incidentally, the closest distance D between the photosensitive member 1 and the developing sleeve 41 is set to be 300 μm.

$$Ea=Ec=Ee=|(Vdc-VL)/D|=0.83\times10^6\ \text{V/m}$$

$$Eb=|(Vp1-VL)/D|=3.8\times10^6\ \text{V/m}$$

$$Ed=|(Vp2-VL)/D=2.2\times10^6\ \text{V/m}$$

Figure 17:
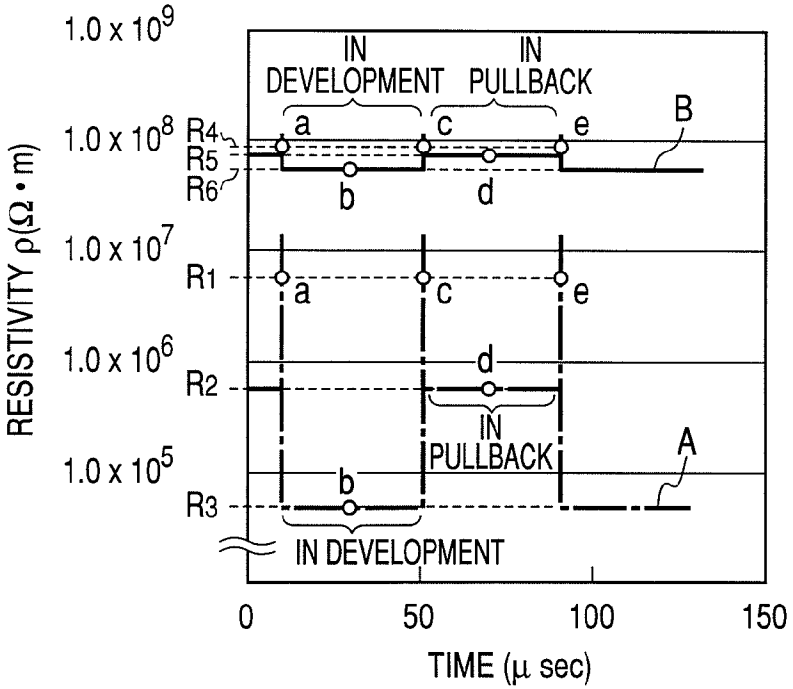
FIG. 17 is a chart for illustrating the fluctuation of the resistivity of the carrier with respect to the change of time under the developing bias in the test example.

Accordingly, from FIGS. 14 and 16, the change of the resistivity of the carrier under the application of the developing bias plotted with respect to the change of time is as illustrated in FIG. 17 in the case of the low-resistance carrier A and the carrier B.

That is, in the case of the low-resistance carrier A, the resistivity R3 of the carrier at the time of the application of the developing electric field Eb (from the resistivity $\rho=9.0\times10^6\Omega\cdot$m at the time of the electric field of $3.3\times10^5$ V/m) is approximately $5.0\times10^4\Omega\cdot$m. That is, at this time, the resistivity of the carrier is significantly decreased, and as a result, the charge in the carrier is easy to be transferred. Incidentally, the resistivity R1 of the low-resistance carrier A at the time of the application of the electric fields Ea, Ec and Ee is approximately $4.7\times10^6\Omega\cdot$m. Furthermore, the resistivity R2 of the low-resistance carrier A at the time of the application of the pullback electric field Ed is approximately $6.2\times10^5\Omega\cdot$m.

Moreover, in the case of the high-resistance carrier B, the resistivity R6 of the carrier at the time of the application of the developing electric field Eb (from the resistivity $\rho=1.0\times10^8\Omega\cdot$m at the time of the electric field of $3.3\times10^5$ V/m) is approximately $6.0\times10^7\Omega\cdot$m. That is, at this time, although the resistivity of the carrier is decreased, the rate of decrease thereof is small. As a result, there is no charge transfer in the carrier, and thus the developability is reduced as compared with the low-resistance carrier A. Incidentally, the resistivity R4 of the high-resistance carrier B at the time of the application of the electric fields Ea, Ec and Ee is approximately $9.3\times10^7\Omega\cdot$m. In addition, the resistivity R5 of the high-resistance carrier B at the time of the application of the pullback electric field Ed is approximately $7.7\times10^7\Omega\cdot$m.

Whereas, the case of the carrier C according to this embodiment, as illustrated in FIG. 14, has characteristics in which the gradient of the change (electric field dependence) of the resistivity thereof comes to be sharp (inflection point P) at an electric field Ep in the vicinity of $2.2\times10^6$ to $3.2\times10^6$ V/m (in more detail, in this example, $2.7\times10^6$ V/m).

That is, as described above, in the case of the carrier C, the gradient of the electric field dependence of the resistivity ρ ($\Delta\rho/\Delta E$) is changed in an electric field intensity Ep in which the relationship of Ed<Ep<Eb holds. When this gradient is expressed using index indication of the ordinate axis of the graph as to the resistivity, in the case of the carrier C of this test example, the gradient K1 of the electric field dependence of the resistivity ρ in the electric field intensity Ed is −2.14 [$\Omega\cdot m^2/v$]. Furthermore, the gradient K2 of the electric field dependence of the resistivity ρ in the electric field intensity Eb is −3.73 [$\Omega\cdot m^2/V$]. That is, $0\geqq K1>K2$ holds.

Therefore, under the application of the developing bias, as the electric field intensity is changed to be Ea→Eb→Ec→Ed→Ee, the resistivity of the carrier C is changed to be R7→R9→R7→R8→R7. Thus, the resistivity only at the time of the resistivity R9 is to be significantly decreased.

Figure 18:
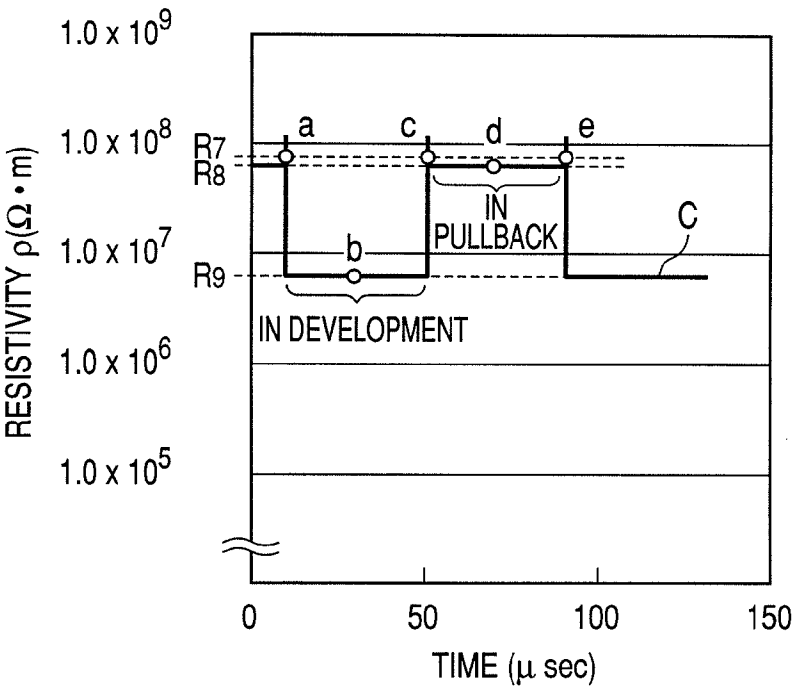
FIG. 18 is a chart for illustrating the fluctuation of the resistivity of the carrier with respect to the change of time under the developing bias in the test example.

The change of the resistivity of this carrier C plotted with respect to the change of time will be as illustrated in FIG. 18.

That is, due to that the resistivity of the carrier C is Eb>Ep during the application of the developing electric field Eb, the resistivity R9 is approximately $6.5\times10^6\Omega\cdot$m. On the contrary, during the application of the pullback electric field Ed, due to that Ed<Ep, the resistivity R8 is approximately $5.8\times10^7\Omega\cdot$m.

Incidentally, the resistivity R7 of the carrier C at the time of the application of the electric fields Ea, Ec and Ee is approximately $8.6\times10^7\Omega\cdot$m.

In the case of the carrier C, only when the developing electric field Eb is formed, the resistivity thereof is in about double-digit decrease, and thus the attractive force between the toner and the carrier is reduced. Therefore, the toner is more likely to be separated from the carrier than in the case of the high-resistance carrier B. On the contrary, when the pullback electric field Ed is formed, the resistivity of the carrier is increased, so that the charge is less likely to be transferred. Accordingly, when the developing electric field Ed is applied, the charge of an opposite polarity hardly flows from the developing sleeve 41 side to the carrier, so that there will not be much reverse charge present in the carrier. Therefore, the toner will be less likely to be pulled back from the photosensitive member 1 to the carrier again, and caught.

With the arrangement, in the case of the carrier C, the electrical resistance is decreased only when the developing electric field Eb is applied, and the developability is ensured as is the low-resistance carrier A. Whereas, when the pullback electric field Ed is applied, the high electrical resistance is kept, and the pullback force is weakened as is the high-resistance carrier B. As a result, the developability becomes totally higher than that of the high-resistance carrier B.

Figure 2:
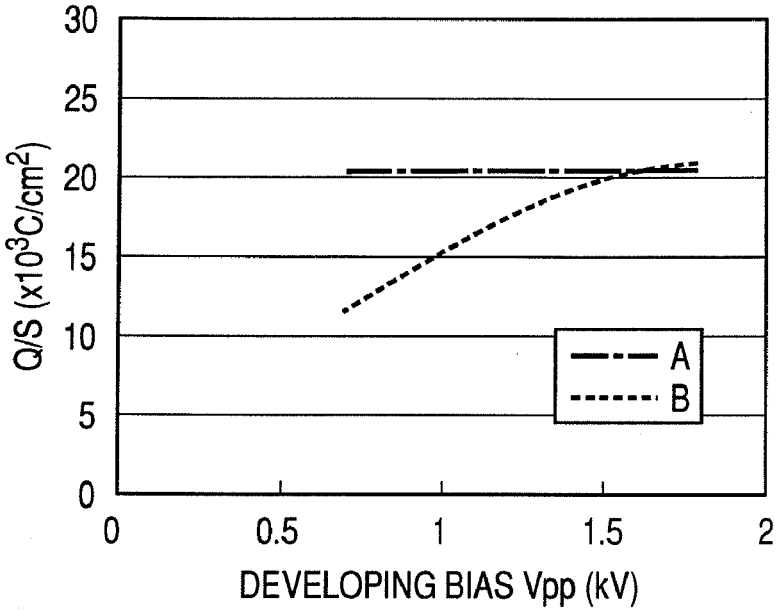
FIG. 2 is a graph for illustrating the difference in developability depending on the carrier.
Figure 19:
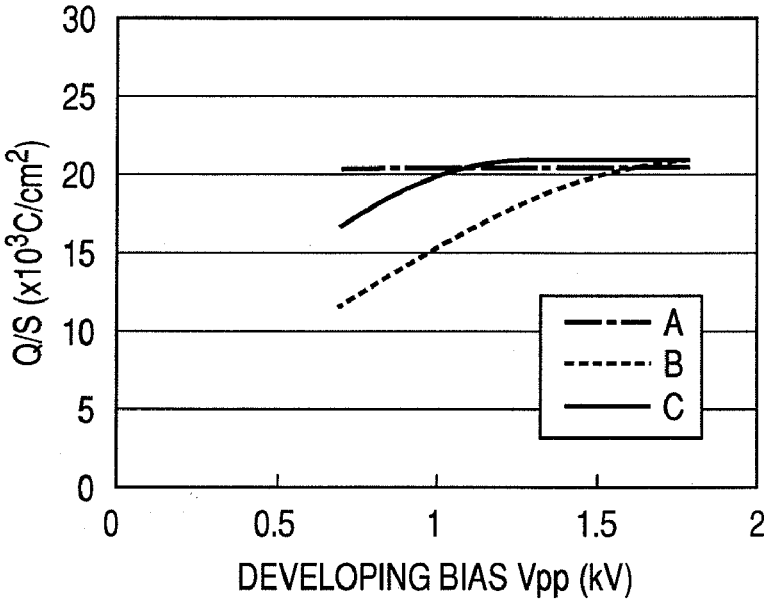
FIG. 19 is a graph for illustrating the difference in developability depending on the carrier in the test example (in the case of using an OPC photosensitive member).

FIG. 19 illustrates results of examination of developability on the occasion of making an actual development operation with the use of an OPC photosensitive member as the photosensitive member 1. As with FIG. 2, in FIG. 19, the abscissa axis represents Vpp of a developing bias, and the ordinate axis represents a charge amount Q/S per a unit area [$C/cm^2$] of a toner layer forming a toner image that is developed on the photosensitive member 1. In addition, FIG. 19 illustrates Vpp dependence of Q/S [$C/cm^2$] on the occasion of development at Vcont=250 V (frequency 12 kHz, rectangular waves) with the use of a toner of Q/M=−30 μC/g with respect to an OPC photosensitive member which film thickness (thickness of a photosensitive layer) is 30 μm and which relative permittivity is 3.3.

From FIG. 19, in the case of using the carrier C, Vpp dependence of Q/S [C/cm$^2$] is found to be lower than the case of using a conventional high-resistance carrier B. Furthermore, the case of using the carrier C, even compared with the case of using the low-resistance carrier A, shows that there is no difference in developability until about Vpp=1.0 kV.

For example, while in the case of using the high-resistance carrier B, at the time of Vpp=1 kV, only M/S=0.5 mg/cm$^2$ can be obtained; in the case of the low-resistance carrier A and the carrier C, at the time of the same Vpp, not less than M/S=0.65 mg/cm$^2$ can be ensured.

This fact shows that when an image output is conducted over a long period in the state in which the value of the developing bias Vpp is determined to be not less than 1.0 kV, for example 1.6 kV, even if the amount of an extraneous additive of the toner is reduced due to separation and embedment, and the attractive force between the toner and the carrier is increased, the developability is not reduced. This is because there is a sufficient developability with respect to the electric field to be applied to a developer.

Figure 20:
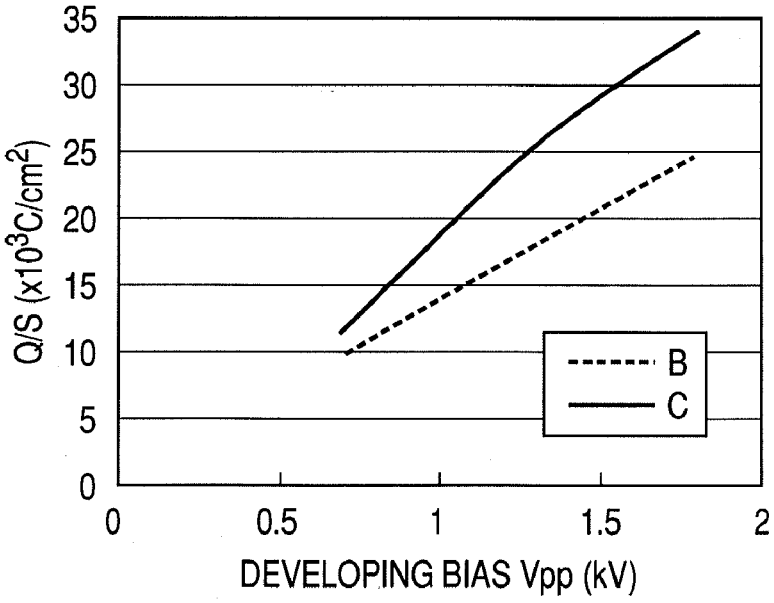
FIG. 20 is a graph for illustrating the difference in developability depending on the carrier in the test example (in the case of using an a-Si photosensitive member).

FIG. 20 illustrates results of examination of developability on the occasion of making an actual development operation with the use of an a-Si photosensitive member as the photosensitive member 1. In FIG. 20, the abscissa axis and the ordinate axis are the same as those in FIGS. 2 and 19.

FIG. 20 illustrates results in the case of using a toner of Q/M=about −60 μC/g, and using an s-Si photosensitive member which film thickness (thickness of the photosensitive layer) is 30 μm and which relative permittivity is 10. Setting of the developing bias is the same as in the case of using the above-mentioned OPC photosensitive member the results of which is illustrated in FIG. 19.

Incidentally, when making a development operation with respect to the above-mentioned a-Si photosensitive member using the low-resistance carrier A, the charge is injected into the photosensitive member 1 via the carrier in development, and thus the potential of an electrostatic image on the photosensitive member 1 will be disturbed. Therefore, in FIG. 20, there is no data in the case of using the low-resistance carrier A.

FIG. 20 shows that in the case of using the high-resistance carrier B, even when Vpp=1.8 kV, only about M/S=0.4 mg/cm$^2$ can be obtained; while, in the case of using the carrier C, at the time of the same Vpp, about M/S=0.6 mg/cm$^2$ can be obtained. With the arrangement, in the case of the photosensitive member 1 of a large capacitance, the advantage of this embodiment was found to be obtained in a more noticeable manner.

Based on the examination of the present inventors, in the case where the capacitance per a unit area of the photosensitive member 1 is not less than $1.7\times10^{-6}$ F/m$^2$, the above-mentioned advantage of preventing the reduction of developability will be exhibited in a particularly marked way. In general, the a-Si photosensitive member has the capacitance in the above-mentioned range. In addition, there are some cases where an OPC photosensitive member which film thickness is comparatively thin has the capacitance in the above-mentioned range. Furthermore, the film thickness of the photosensitive member 1 is normally approximately not less than 20 μm, so that the capacitance per a unit area is not more than about $1.46\times10^{-6}$ F/m$^2$.

Incidentally, the capacitance per a unit area of the photosensitive member 1 can be obtained as follows.

$$C=(\epsilon 0\times\epsilon d)/d$$

C: capacitance

ϵ0: vacuum permittivity

ϵd: permittivity of photosensitive member d: film thickness of photosensitive member Now, a charge injection to disturb the potential of an electrostatic image of the photosensitive member 1 will be described.

Here, as the conditions likely to be affected by the charge injection, using an a-Si photosensitive member as the photosensitive member 1, and using the low-resistance carrier A as a carrier, the electric field of starting the charge injection having been described above referring to FIG. 12 was examined.

Figure 21B:
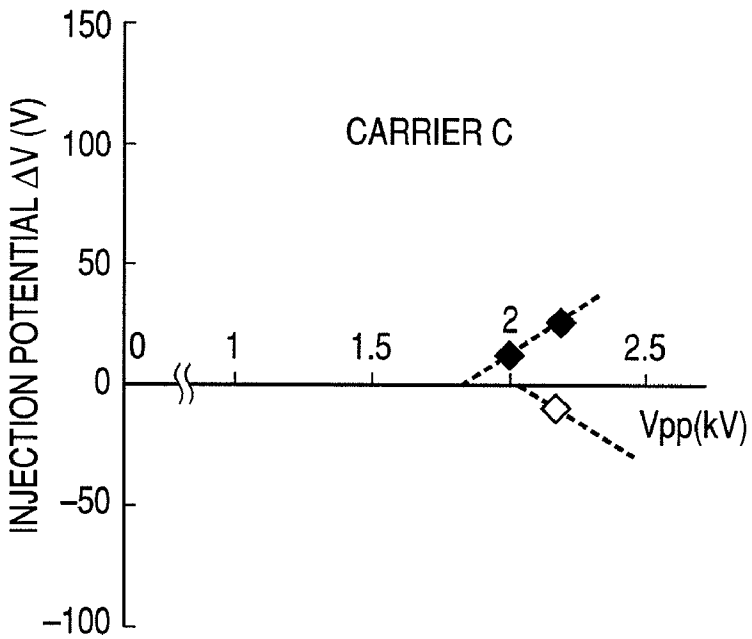
FIGS. 21A and 21B are graphs illustrating results of the examination of the charge injection amount of the carrier in the test example.
Figure 21A:
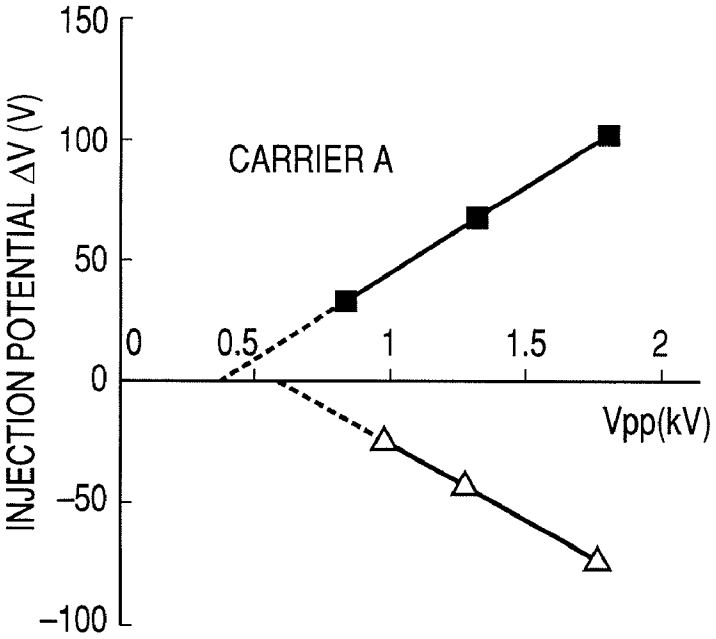

FIGS. 21A and 21B illustrate one example of results of examining the state of the occurrence of charge injection in the case of using the low-resistance carrier A and using an a-Si photosensitive member as the photosensitive member 1.

FIGS. 21A and 21B illustrate how much the VL potential and the VD potential of an electrostatic image that is formed on the photosensitive member 1 are changed by the contact with the carrier under the application of the developing bias, that is results of ΔVL and ΔVD by changing VPP. ΔVL and ΔVD are expressed with the following equations.

$$\Delta VL=VL-VL'$$

where: VL is the potential of the original (before the carrier is contacted) highest density portion (solid black portion); and VL' is the VL potential after the carrier has been contacted.

$$\Delta VD=VD-VD'$$

where: VD is the potential of the original (before the carrier is contacted) no-image portion (solid white portion); and VD' is the VD potential after the carrier has been contacted.

Here, the above-mentioned VL, VL', VD, and VD', as illustrated in FIG. 11, are to be measured by means of a surface electrometer Vs downstream of the developing portion G in the moving direction of the surface of the photosensitive member 1. VL and VD are measured in the state of no developing device 4, and VL' and VD' are measured in the state in which the developing device 4 is located and a predetermined developing bias is applied.

Incidentally, the developing bias is an alternate bias of a frequency f=12 kHz (rectangular waves), Vdc=−350 V. Furthermore, the VL potential and the VD potential in the case where the carrier is not contacted are set to be VL=−100 V and VD=−500 V respectively.

In FIG. 21A, the line plotted with ■ represents the amount of charge injection with respect to the VL potential. When Vpp=0.7 kV, VL'=−125 V, and ΔVL=about 25 V. Moreover, when Vpp=1.3 kV, VL'=−165 V, and ΔVL=about 65 V. In addition, when Vpp=1.8 kV, VL'=−200 V, and ΔVL=about 100 V.

Furthermore, in FIG. 21A, the line plotted with Δ represents the amount of charge injection with respect to the VD potential. At Vpp=1 kV, 1.3 kV, 1.8 kV, ΔVD are about −25 V, −45 V, −75 V respectively.

From the graph of FIG. 21A, the Vpp at which the charge injection amount is zero is approximately 0.35 kV with respect to the VL potential. The electric field on this occasion is Ef1=|(Vp1−VL)/D|=$1.4\times10^6$ V/m.

Whereas, from the graph of FIG. 21A, the Vpp at which the charge injection amount is zero is approximately 0.5 kV with respect to the VD potential. The electric field on this occasion is Eft=|(Vp2−VD)/D|=1.4×10$^6$ V/m as well.

That is, when the resistivity of the carrier is less than the resistivity of the carrier when the above-mentioned electric field of 1.4×10$^6$ V/m is applied, the charge injection into the electrostatic image on the photosensitive member 1 will occur via the carrier. Further, the resistivity ρ=ρAs of the carrier A when the above-mentioned electric field is applied was found to be approximately 2.2×10$^6$Ω·m.

Figure 22:
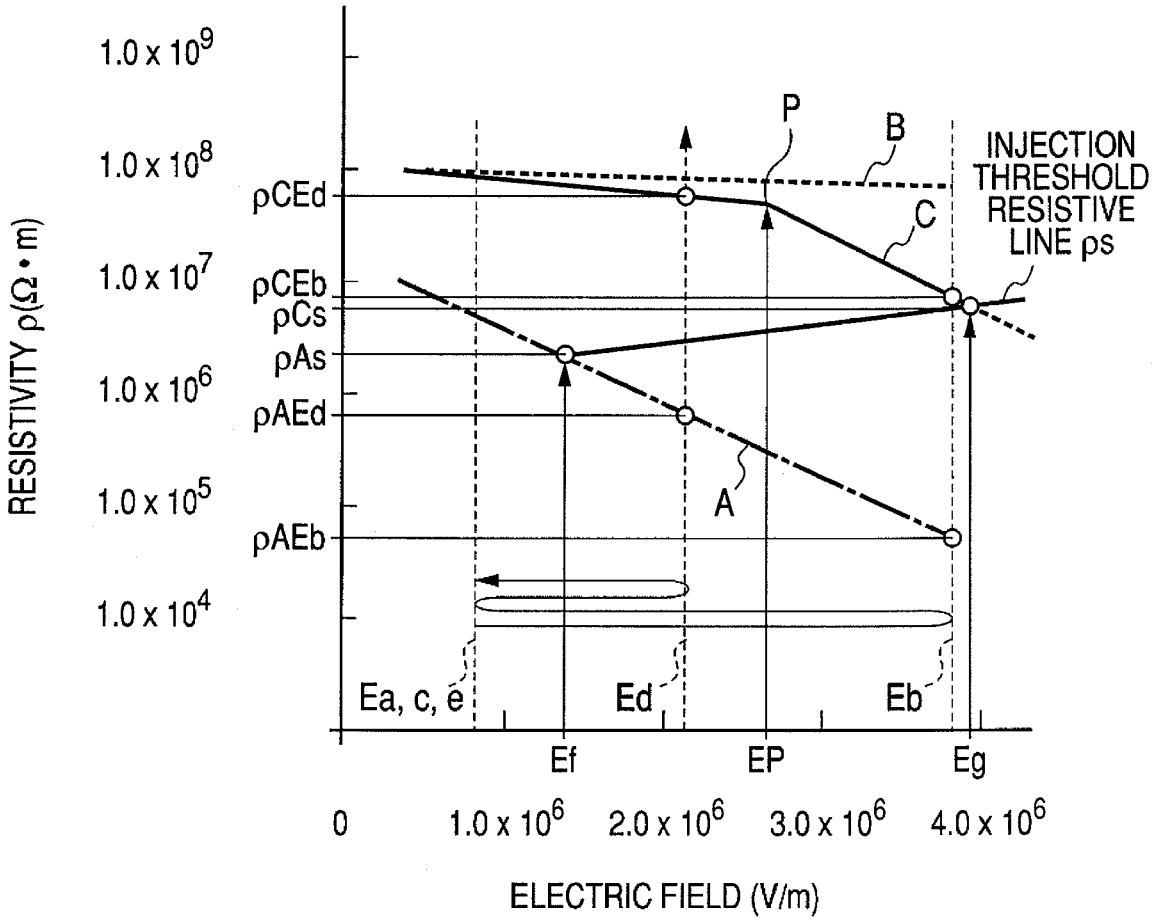
FIG. 22 is a graph for illustrating the fluctuation of the resistivity of the carrier and the charge injection threshold in the application of the developing bias in the test example.
Figure 23A:
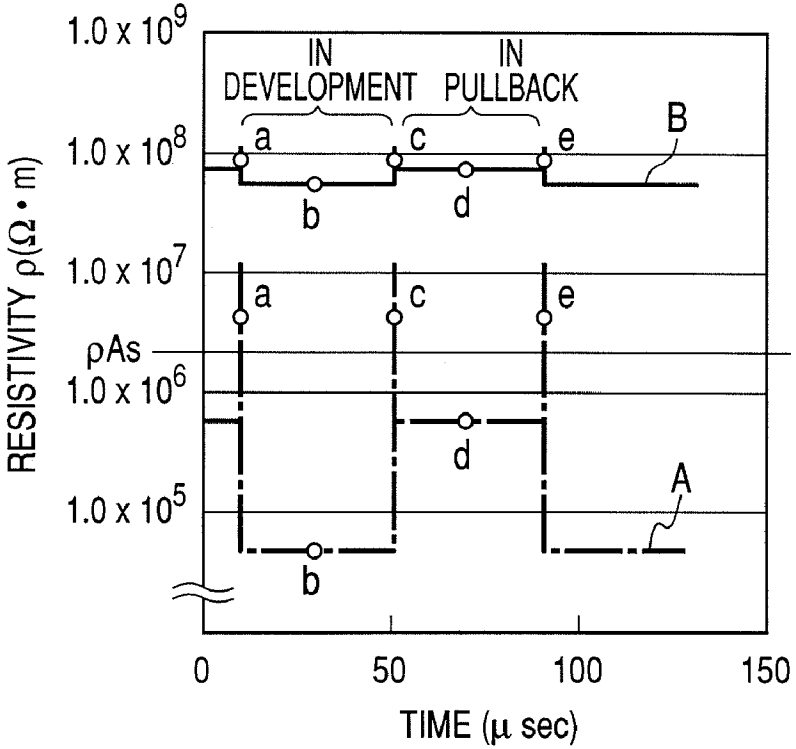
FIGS. 23A and 23B are graphs for illustrating the fluctuation of the resistivity of the carrier and the charge injection threshold with respect to the change of time under the developing bias in the test example.

The above-mentioned results having been checked with FIG. 14 are illustrated in FIG. 22, and those having been checked with FIG. 17 are illustrated in FIG. 23A.

In addition, results of making the same test as mentioned above with the carrier C are illustrated in FIG. 21B.

In FIG. 21B, the line plotted with ♦ represents the amount of charge injection with respect to the VL potential.

When Vpp=1.8 kV, VL'=−100 V, and ΔVL=0 V. Moreover, when Vpp=2.0 kV, VL'=about −110 V, and ΔVL=10 V. In addition, when Vpp=2.2 kV, VL'=about −125 V, and ΔVL=25 V.

Furthermore, in FIG. 21B, the line plotted with ◇ represents the amount of charge injection with respect to the VD potential. At Vpp=2.0 kV, 2.2 kV, ΔVD=0 V, −10 V respectively.

From the graph of FIG. 21B, the Vpp at which the charge injection amount is zero is approximately 1.9 kV with respect to the VL potential. The electric field on this occasion is Eg1=|(Vp1−VL)/D|=4.0×10$^6$ V/m.

Whereas, from the graph of FIG. 21B, the Vpp at which the charge injection amount is zero is approximately 2.1 kV with respect to the VD potential. The electric field on this occasion is Eg2=|(Vp2−VD)/D≡=4.0×10$^6$ V/m as well.

That is, when the resistivity of the carrier C is less than the resistivity of the carrier when the above-mentioned electric field of 4.0×10$^6$ V/m is applied, the charge injection into the electrostatic image will occur. Further, the resistivity ρ=ρCs of the carrier C when the above-mentioned electric field is applied was found to be approximately 5.0×10$^6$Ω·m.

Figure 23B:
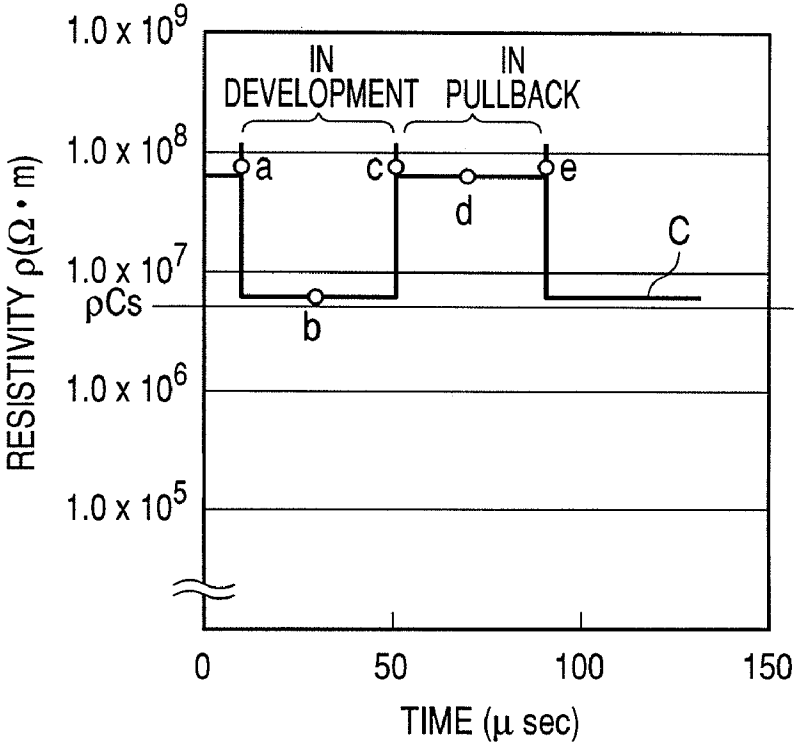

The above-mentioned results having been checked with FIG. 14 are illustrated in FIG. 22, and those having been checked with FIG. 18 are illustrated in FIG. 23B.

As illustrated in FIGS. 22 and 23, for example, thought is the case where the Vpp under the application of the developing bias is 1.8 kV, that is, the case where the developing electric field Eb=3.8×10$^6$ V/m and the pullback electric field Ed=2.2×10$^6$ V/m are formed. Here, the resistivities of the carrier A when the electric fields Eb and Ed are applies are to be ρAEb, ρAEd respectively. Moreover, the resistivities of the carrier C when the electric fields Eb and Ed are applied are to be ρCEb, ρCEd respectively.

At this time, the carrier A is in a relationship of ρAs>ρAEd, ρAEb. Therefore, both when the developing electric field Eb is formed and when the pullback electric field Ed is formed, the charge injection will occur.

Whereas, the carrier C is in the relationship of ρCs<ρCEd, ρCEb. Therefore, both when the developing electric field Eb is formed and when the pullback electric field Ed is formed, the charge injection is prevented.

Here, when letting the line providing a connection between the above-mentioned ρAs and ρCs an injection threshold resistive line ρs, it means that in the case where the resistivity of the carrier comes to be below this line ρs, the charge injection occurs. Hereinafter, the injection threshold resistive line ρs will be described.

Figure 30:
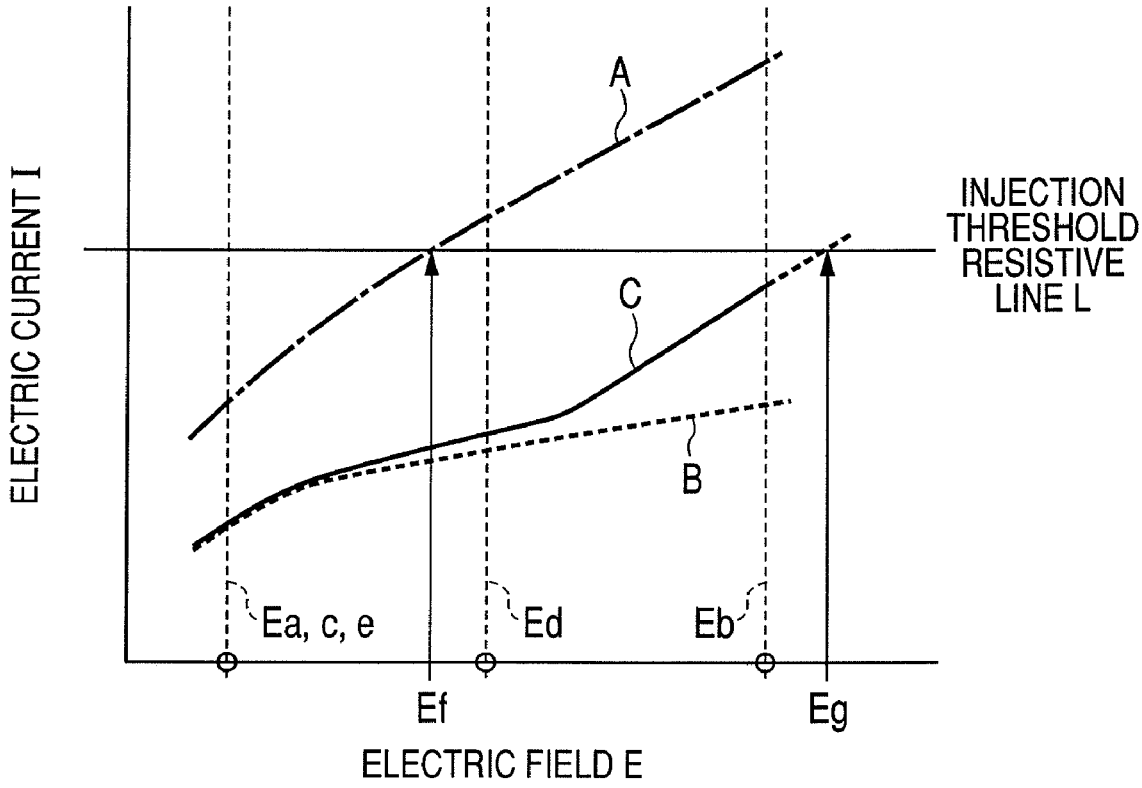
FIG. 30 is a graph for illustrating the relationship between a current flowing through the carrier and the charge injection.

In the case of the carrier A, it is described above that the resistivity of starting the charge injection is to be ρAs. On this occasion, the amount of current flowing through the carrier is approximately 2.2×10$^{-4}$ A. On the other hand, a current value at the time of the resistivity ρCs in the case of the carrier C is also approximately 2.2×10$^{-4}$ A. That is, the state in which not less than a predetermined current value (current threshold) starts to flow through the carrier is thought to be the state of starting the charge injection. Accordingly, the resistivity on the injection threshold resistive line ρs shows the resistivity at the above-mentioned current threshold (predetermined value). Therefore, when coming to be the resistivity below this injection threshold resistive line ρs, more current than the above-mentioned current threshold is to flow (refer to the injection threshold current line L illustrated in FIG. 30). With the arrangement, the injection threshold resistive line ρs means the threshold of charge injection.

Here, when approximating the injection threshold resistive line ρs, ρs=1.1×10$^6$×e$^N$ [Ω·m]:

where: e is the base of natural logarithms (e≈2.71828); and N=4×E×10$^{-7}$.

Then, when letting the resistivity ρsEb of the carrier at the developing electric field Eb, it is shown that in case where this resistivity is more than the resistivity ρsEb that is expressed by the following equation, $$\rho sEb = 1.1\times10^6\times e^n\ [\Omega\cdot m]$$

where: e is the base of natural logarithms (e≈2.71828); and n=4×Eb×10$^{-7}$, the charge injection is prevented at the time of the application of the developing electric field.

Figure 29:
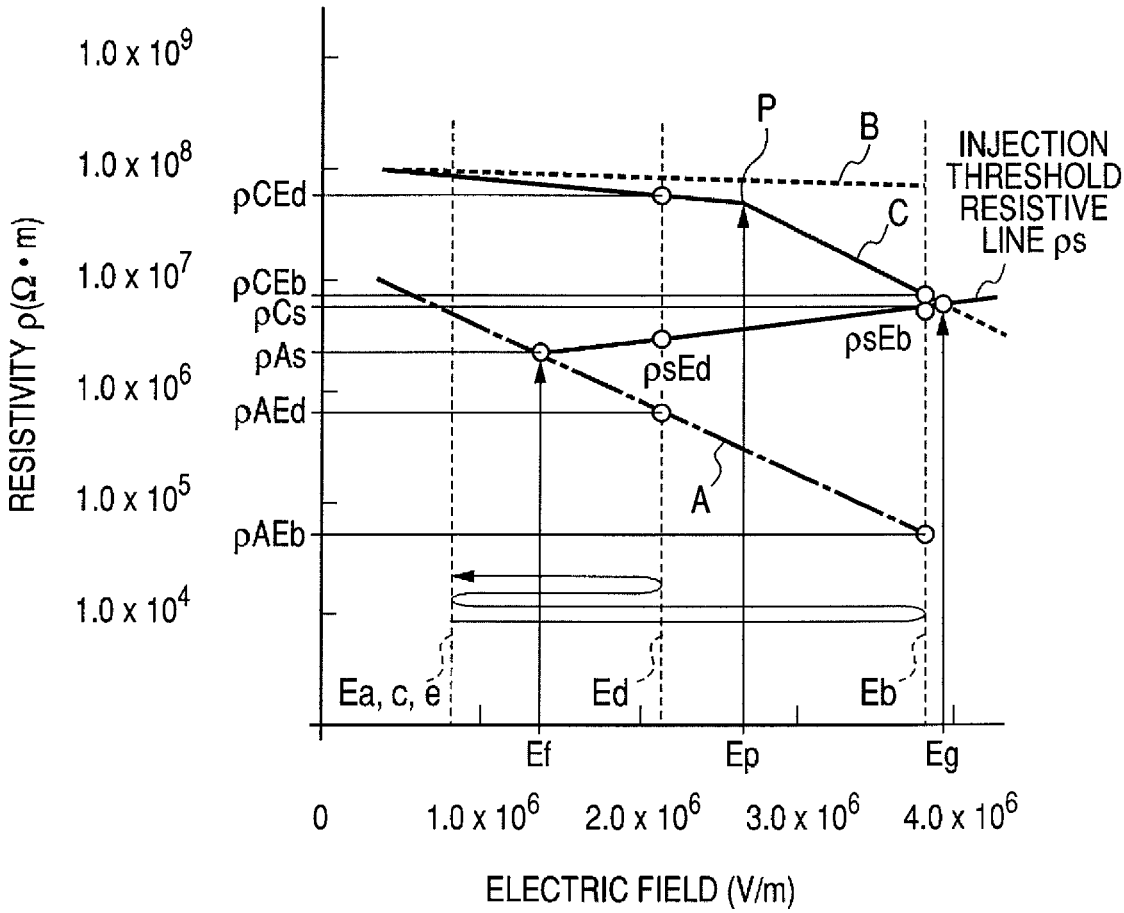
FIG. 29 is a graph for illustrating the fluctuation of the resistivity of the carrier and the charge injection threshold in the application of the developing bias.

As illustrated in FIG. 29, in this example, the resistivity ρAEb at the time of the application of the electric field Eb in the case of the carrier A is approximately 5.0×10$^4$Ω·m. On the other hand, the resistivity ρCEb at the time of the application of the electric field Eb in the case of the carrier C is approximately 6.5×10$^6$Ω·m. Here, the resistivity ρsEb at the application of the electric field Eb on the injection threshold resistive line ρs is approximately 5.1×10$^6$Ω·m. Therefore, it is in the relationship of ρAEb<ρsEb<ρCEb. Thus, although the charge injection occurs in the case of the carrier A, there is no charge injection in the case of the carrier C.

In addition, in this embodiment, the resistivity ρAEd at the time of the application of the electric field Ed in the case of the carrier A is approximately 6.2×10$^5$Ω·m. On the other hand, the resistivity ρCEd at the time of the application of the electric field Ed in the case of the carrier C is approximately 5.8×10$^7$Ω·m. To suppress the charge injection, the resistivity ρCEd at the time of the application of the electric field Ed in the case of the carrier C is desired to be larger than 6.2×10$^5$Ω·m. Here, the resistivity ρsEd at the time of the application of the electric field Ed on the injection threshold resistive line ρs is approximately 2.6×10$^6$Ω·m. Therefore it is in the relationship of ρAEd<ρsEd<ρCEd. Thus, although the charge injection occurs in the case of the carrier A, there is no charge injection in the case of the carrier C.

Now, the relationship between the electric fields Eb and Ed and the injection threshold resistive line ρs will be described. Here, to facilitate understanding of the following description, descriptions will be made using a carrier D which characteristics are similar to those of the carrier C.

Figure 28:
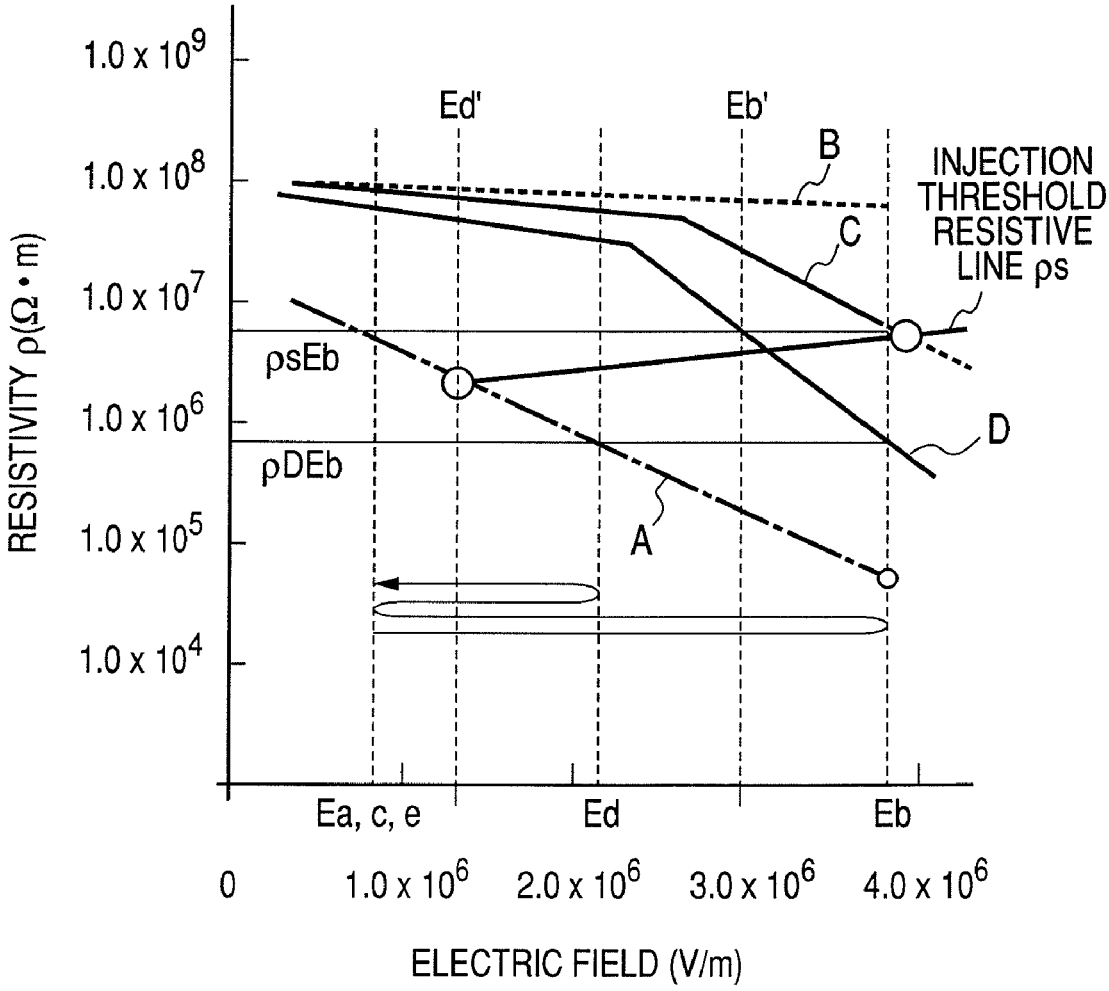
FIG. 28 is a graph for illustrating the fluctuation of the resistivity of the carrier and the charge injection threshold in the application of the developing bias.

The carrier D, as described above, has an inflection point and K1 and K2 that are different from those of the carrier C by controlling the sintering temperature and the amount of a blowing agent in the manufacturing process. In FIG. 28, the electric field dependence of the resistivity of the carrier A, B, C as well as the carrier D are illustrated.

Although the carrier D has similar characteristics to those of the carrier C, the resistivity ρDEb at the time of the application of the developing electric field Eb=3.8×10$^6$ V/m (Vpp 1.8 kV) is below the injection threshold resistive line ρs.

Therefore, it is in the relationship of ρsEb>ρDEb, the charge injection occurs at the time of the application of the electric field Eb.

With the arrangement, despite a carrier having an inflection point, and K1 and K2 as with the carrier C, when the resistivity at the electric field Eb is below the injection threshold resistive line ρs, the charge injection will occur.

Nevertheless, in such a case, by decreasing the value of the electric fields Eb and Ed, that is Vpp regarding the developing bias, the charge injection can be prevented.

For example, in the case of Vpp=1.3 kV, the developing electric field Eb=$3.0\times10^6$ V/m, and the pullback electric field Ed=$1.3\times10^6$ V/m. In this case, the resistivity ρDEb at the time of the application of the electric field Eb of the carrier D is approximately $1\times10^7\Omega\cdot$m. Whereas, the resistivity ρsEb on the injection threshold resistive line ρs at the time of the application of the developing electric field Eb=$3.0\times10^6$ V/m is $3.7\times10^6\Omega\cdot$m. Thus, since it is in the relationship of ρsEb<ρDEb, no charge injection will occur at Vpp=1.3 kV.

However, by decreasing the Vpp as described above, although the charge injection in development can be prevented, since conversely, the electric field intensity for developing the toner is weakened at that rate, the developability itself is affected. Therefore, it is not desirable to decrease the Vpp up to infinity.

Although the proper Vpp is changed depending on the attractive force between a toner and a carrier to be selected, it is preferably $1.6\times10^6$ [V/m]<Eb<$3.9\times10^6$ [V/m], $1.6\times10^5$[V/m]<Ed<$2.5\times10^6$ [V/m].

Accordingly, in the range of the above-mentioned Eb and Ed, it is desirable to make an adjustment such that the inflection point Ep of the resistivity of the carrier satisfies the relationship of Ed<Ep<Eb.

In addition, the resistivity ρb of the carrier at the time of the application of the developing electric field Eb is preferably less than $6.0\times10^7\Omega\cdot$m. In the case of larger than this value, there is a possibility that the attractive force between the toner and the carrier cannot be reduced, and thus a good developability cannot be obtained.

That is, preferably, the developing electric field Eb is in the range of $1.6\times10^6$ [V/m]<Eb<$3.9\times10^6$ [V/m].

Furthermore, preferably, the resistivity ρb of the carrier C at the time of the application of such electric field Eb is above the injection threshold resistive line that is expressed by ρsEb=$1.1\times10^6\times e^n$ [Ω·m]

where: e is the base of natural logarithms; and n=$4\times Eb\times10^{-7}$], thus to satisfy the relationship of ρsEb<ρb.

Furthermore, the resistivity ρb of the carrier C at the time of the application of such electric field Eb is less than $6.0\times10^7\Omega\cdot$m.

With the arrangement, it is desirable that the resistivity ρb [Ω·m] of the carrier C at the time of the application of the electric field Eb in the range of $1.6\times10^6$ [V/m]<Eb<$3.9\times10^6$ [V/m] satisfies the relationship of ρsEb<ρb<$6.0\times10^7$.

Incidentally, in the above description, is described an example in which particularly as the condition likely to be affected by the charge injection, using an a-Si photosensitive member as the photosensitive member 1, the resistivity of a carrier for preventing the charge injection into an electrostatic image is examined. Based on the examination by the present inventors, by setting the resistivity of a carrier for preventing the charge injection into an electrostatic image which resistivity has been obtained by such examination, even in the case of using the other photosensitive member such as an OPC photosensitive member, the charge injection into the electrostatic image can be prevented well.

As described above, by having electrical resistance characteristics of the carrier C as described above, in application of a developing bias (alternate bias voltage) in which an AC bias and a DC bias are superimposed, the resistance value of the carrier is decreased only when a developing electric field Eb is formed. Whereby, the electric field to be formed around the carrier comes to be larger, and thus the force of separating the toner from the carrier becomes larger than in the case of the high-resistance carrier B, to improve developability. In addition, by adjusting the material and construction of the carrier such that the resistivity ρb of the carrier when the developing electric field Eb in a development operation is formed is larger than the above-mentioned ρsEb, the charge injection into an electrostatic image on the photosensitive member 1 via the carrier in the development operation can be prevented.

Heretofore, although the present invention is described according to the specific embodiment, it is to be appreciated that the present invention is not limited to the above-described embodiment.

For example, in each embodiment as described above, descriptions are made in the case where a photosensitive member is charged to be of a negative polarity, and an electrostatic image is formed on the photosensitive member by an image exposure method. However, the present invention is not limited to this case, it is preferable that the charging polarity of the photosensitive member be a positive polarity. Furthermore, it is preferable that an electrostatic image is formed on the photosensitive member by a background exposure method in which the electrostatic image is formed by making an exposure at the no-image portion where a toner has not to be adhered. In addition, it is preferable to employ a normal development method (developing an image portion that is not exposed on the photosensitive member) of using the toner that is charged to be of an opposite polarity to the charging polarity of the photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-287017, filed Oct. 20, 2006, No. 2007-267127, filed Oct. 12, 2007, which are hereby incorporated by reference herein in their entirety.

What is claimed is:

1. An image forming apparatus comprising:

an image bearing member; and a developer bearing member bearing a developer including a toner and a carrier, the developer bearing member developing an electrostatic image formed on the image bearing member with the developer, and the developer bearing member being applied with an alternate voltage in order to form an alternate electric field between the developer bearing member and the image bearing member, wherein in a semi-logarithmic graph in which an abscissa axis represents an electric field intensity to be applied to the carrier, an ordinate axis represents a resistivity of the carrier on a logarithmic scale, letting electric field intensities Eb, Ed $$Eb=|(Vp1-VL)/D| \text{ and}$$

$$Ed=|(Vp2-VL)/D|$$

(where: VL is a potential [V] of the electrostatic image for obtaining the highest density;

Vp1, of peak potentials of the alternate voltage, is a peak potential [V] providing such a potential difference as to move the toner toward the image bearing member with respect to the VL potential;

Vp2, of peak potentials of the alternate voltage, is a peak potential [V] providing such a potential difference as to move the toner toward the developer bearing member with respect to the VL potential; and D is the closest distance [m] between the image bearing member and the developer bearing member), and letting a gradient at Ed equal K1, and a gradient at Eb equal K2: K1 and K2 satisfy $0 \geqq K1 > K2$; and a resistivity ρb of the carrier at the electric field intensity Eb satisfies $\rho b < 6.0 \times 10^7$ [Q·m]

wherein satisfied are relationships of $$1.6 \times 10^6 < Eb < 3.9 \times 10^6 \text{ [V/m] and}$$

$$1.6 \times 10^5 < Ed < 2.5 \times 10^6 \text{ [V/m].}$$

2. An image forming apparatus according to claim 1, wherein said carrier includes a porous core of which spaces are filled with resin.

3. An image forming apparatus according to claim 1, wherein a capacitance of the image bearing member is not less than $1.7 \times 10^{-6}$ [F/m$^2$].

4. An image forming apparatus according to claim 1, wherein the image bearing member is a photosensitive member including an amorphous silicon layer.

5. An image forming apparatus according to claim 1, wherein the resistivity ρd of the carrier at the electric field intensity Ed is larger than $6.2 \times 10^5$ [Ω·m].

* * * * *